US009833965B2

(12) United States Patent
Wakatabi et al.

(10) Patent No.: US 9,833,965 B2
(45) Date of Patent: Dec. 5, 2017

(54) SEALED LETTER PRODUCING DEVICE AND ENVELOPE SHEET

(75) Inventors: Tadayuki Wakatabi, Tokyo (JP); Yasuhiro Katada, Tokyo (JP)

(73) Assignee: RISO KAGAKU CORPORATION, Tokyo (JP)

( * ) Notice: Subject to any disclaimer, the term of this patent is extended or adjusted under 35 U.S.C. 154(b) by 707 days.

(21) Appl. No.: 13/881,485

(22) PCT Filed: Oct. 26, 2011

(86) PCT No.: PCT/JP2011/074667
§ 371 (c)(1),
(2), (4) Date: Jun. 6, 2013

(87) PCT Pub. No.: WO2012/057202
PCT Pub. Date: May 3, 2012

(65) Prior Publication Data

US 2013/0260977 A1 Oct. 3, 2013

(30) Foreign Application Priority Data

Oct. 26, 2010 (JP) ..... 2010-239789
Sep. 28, 2011 (JP) ..... 2011-212814

(51) Int. Cl.
*B31B 49/04* (2006.01)
*B43M 3/04* (2006.01)
(Continued)

(52) U.S. Cl.
CPC ..... *B31B 49/04* (2013.01); *B43M 3/04* (2013.01); *B43M 5/04* (2013.01); *B43M 5/047* (2013.01);
(Continued)

(58) Field of Classification Search
CPC ..... B43M 3/04; B43M 5/04; B31B 49/04
(Continued)

(56) References Cited

U.S. PATENT DOCUMENTS 4,202,150 A 5/1980 Petersson
4,787,192 A * 11/1988 Gunther, Jr. ..... B43M 3/04 271/110
(Continued)

FOREIGN PATENT DOCUMENTS

EP 1693187 A2 * 8/2006 ..... B31B 19/88
FR 2888774 A1 1/2007
(Continued)

OTHER PUBLICATIONS

Europe Patent Office, "Search Report for EP 11836335.7," dated Jul. 15, 2014.
(Continued)

*Primary Examiner* — Andrew M Tecco
*Assistant Examiner* — Praachi M Pathak
(74) *Attorney, Agent, or Firm* — Manabu Kanesaka

(57) ABSTRACT

In a sealed letter producing device which folds and seals, with a content, an envelope sheet on which pressure-sensitive adhesives are provided, sealing with pressure rollers smaller than in conventional rollers is achieved.
Pressure-sensitive adhesives 106 are provided in both edge portions in the width direction of an envelope sheet 100, and remoistening paste 107 is provided inwardly of both edge portions. The remoistening paste is moistened when the envelope sheet wrapping a content is bent and formed into an envelope 50, the entire surface of the envelope is pressurized by low-pressure rollers and adhered with the remoistening paste, and further only both edge portions of the envelope 50 are pressurized by an upper and lower set and a left and right pair of the pressure rollers 80, 80 having a small width to adhere the pressure-sensitive adhesive 106. High pressure required for adhesion of the pressure-sensitive adhesives is only necessary in both edge portions of the envelope, and therefore small pressure rollers 80 will suffice.

5 Claims, 28 Drawing Sheets

(51) Int. Cl.

| | |
|---|---|
| ***B43M 5/04*** | (2006.01) |
| ***B65D 27/14*** | (2006.01) |
| ***G03G 15/00*** | (2006.01) |
| ***B65D 27/34*** | (2006.01) |
| ***B65D 27/36*** | (2006.01) |

(52) U.S. Cl.
CPC ..... *B65D 27/14* (2013.01); *B65D 27/34* (2013.01); *B65D 27/36* (2013.01); *G03G 15/6594* (2013.01); *G03G 2215/00426* (2013.01); *G03G 2215/00514* (2013.01)

(58) Field of Classification Search
USPC ..... 229/92.1; 156/449, 555; 53/284.3
See application file for complete search history.

(56) References Cited

U.S. PATENT DOCUMENTS 4,951,864 A * 8/1990 Dicker ..... B42D 5/025 229/80
4,972,655 A 11/1990 Ogawa
5,511,357 A * 4/1996 Ricketts ..... B43M 5/042 53/284.3
5,560,185 A * 10/1996 Petkovsek ..... B43M 5/042 53/284.3
5,568,717 A * 10/1996 Harrod ..... B31B 1/36 53/116
5,702,098 A * 12/1997 Gottlieb ..... B43M 5/042 270/58.06
5,829,670 A 11/1998 Lombardo et al.
5,960,607 A * 10/1999 Bohn ..... B31B 41/00 493/216
6,019,280 A 2/2000 Peterson
6,162,316 A 12/2000 Spitler et al.
6,179,952 B1 1/2001 Spranger
6,196,453 B1 * 3/2001 Hutchinson ..... B42D 5/026 229/305
7,398,635 B2 * 7/2008 Fairweather ..... B43M 3/045 53/284.3
8,801,044 B2 8/2014 Stemmle et al.
2002/0029713 A1 * 3/2002 Morizumi ..... B41M 3/005 101/483
2002/0170681 A1 * 11/2002 Saurer ..... B41J 2/16547 156/441.5
2003/0121236 A1 * 7/2003 Middelberg ..... B43M 5/04 53/460
2006/0185326 A1 * 8/2006 Woodman ..... B31B 19/26 53/429
2006/0186592 A1 * 8/2006 Stemmle ..... B31B 19/26 270/58.07
2008/0149261 A1 * 6/2008 Farmer ..... B43M 3/045 156/196
2008/0172145 A1 * 7/2008 Freyburger ..... B43M 3/02 700/233
2009/0031903 A1 * 2/2009 Collings ..... B41J 13/12 101/26
2009/0107086 A1 * 4/2009 Keane ..... B43M 5/04 53/206
2010/0089990 A1 * 4/2010 Spaulding ..... B65D 27/04 229/301
2013/0260977 A1 * 10/2013 Wakatabi ..... B65D 27/14 493/188

FOREIGN PATENT DOCUMENTS

IT WO 2009093186 A1 * 7/2009 ..... B43M 3/04
JP 2521498 B2 5/1996
JP 2001-322377 A 11/2001
JP 3343165 B2 11/2002
JP 3491921 B2 2/2004
JP 2006-82388 A 3/2006
JP 2006-272944 A 10/2006
WO 2009093186 A1 7/2009

OTHER PUBLICATIONS

Europe Patent Office, "Search Report for European Patent Application No. 15194168.9," dated Apr. 4, 2016.
PCT, "International Search Report for PCT/JP2011/074667", dated Feb. 7, 2012.

* cited by examiner

SEALED LETTER PRODUCING DEVICE AND ENVELOPE SHEET

RELATED APPLICATIONS

The present application is National Phase of International Application No. PCT/JP2011/074667 filed Oct. 26, 2011, and claims priority from Japanese Application No. 2010-239789, filed Oct. 26, 2010 and Japanese Application No. 2011-212814, filed Sept. 28, 2011.

TECHNICAL FIELD

The present invention relates to a sealed letter producing device which is capable of printing on a paper sheet which serves as an envelope a paper sheet of a content, and performing the operation of enclosing and sealing a content in the envelope by folding the paper sheet which becomes the envelope with a simple configuration, and such a device suitable for an envelope sheet (a paper sheet which forms an envelope when folded).

BACKGROUND ART

Patent document 1 described below discloses an invention relating to a method for producing a sealed letter by folding in three. An envelope sheet which is substantially similar to a sealed letter form used in this invention is shown in FIGS. 31 and 32. As shown in FIG. 31, this envelope sheet 300 includes three paper pieces: an upper paper piece 301, a middle paper piece 302, and a lower paper piece 303, connected by perforations. Name and address are written on the front side of the upper paper piece 301, contents are written on the front sides the middle paper piece 302 and lower paper piece 303. On the front side of the middle paper piece 302 and lower paper piece 303, a pressure-sensitive adhesive 305 is formed in an approximate square U-shape and in a band-shaped pattern along the external forms of two paper piece other than perforations. No pressure-sensitive adhesive is present on the front side of the upper paper piece 301 which will finally be the other surface. Moreover, nothing is written on the back sides of the upper paper piece 301, the middle paper piece 302 and lower paper piece 303, or a printing pattern is formed to prevent the content from being seen through. On the back sides of the upper paper piece 301 and middle paper piece 302, the pressure-sensitive adhesive 305 is formed in a band-shaped pattern along the outer edge other than perforations and part of the sides. No pressure-sensitive adhesive is present on the back side of the lower paper piece 303 which will be the outer back side finally.

After name, address, contents and other information are printed, in the case where the envelope sheet 300 is formed into the shape of the envelope, the front side of the middle paper piece 302 and the front side of the lower paper side 303 are placed together as shown in FIG. 19 and the pressure-sensitive adhesives 305 on both paper pieces are brought into contact with eachother. Furthermore, as shown in FIG. 32, the back side of the upper paper side 301 and the back side of the middle paper side 302 are placed together to bring the pressure-sensitive adhesives 305 on both paper pieces into contact with each other. The envelope sheet 300 is in the form of a folded-in-three envelope in this state, but the pressure-sensitive adhesives 305 are not adhered yet.

Thereafter, as shown in FIG. 4 of the above patent document 1, the envelope is nipped by a pair of rollers whose size in the axial direction is greater than their length in the width direction of the envelope, and is transferred while applying a high pressure on the entire surface of the envelope. In FIG. 4 of the above patent document 1, a pressure is applied to the entire surface of the envelope by two pairs of rollers which are longer than the width of the envelope. Accordingly, the pressure-sensitive adhesives which are in contact with each other between the paper pieces facing each other develops tackiness, and a sealed envelope, that is, a sealed letter is produced.

In the technique described above, a sealed letter is produced by folding the envelope sheet, a pressure-sensitive adhesive which requires pressure has been used for the adhesion of the paper pieces of the envelope sheet. In addition, other adhesion sections include a method of applying an adhesive such as hot melts immediately before folding the envelope sheet.

Patent document 1: Japanese Patent Publication No. 2521498

DISCLOSURE OF INVENTION

Problems to be Solved by the Invention

When an adhesive such as a hot melt is used as an adhesion section in the case where a sealed letter is produced by folding an envelope sheet, its application device is complicated and expensive, a heating section is also necessary, the whole system becomes a large-scale device such as a factory, therefore the limitation of the installation site is significant, and maintenance operation is also necessary. For these reasons, it is difficult to employ such an adhesive as the adhesion section of the sealed letter producing device.

Moreover, in the sealed letter producing device using the pressure-sensitive adhesive described with reference to the above patent document 1 and FIGS. 31 and 32, the adhered portion only needs to be pressurized, and therefore maintenance is unnecessary. Since the sealed letter producing device is simpler than a device using adhesives such as hot melts, it can be a relatively small device.

However, in the sealed letter producing device using a pressure-sensitive adhesive, the pressure applied on the adhered portion of the envelope is as high as about 1 ton/square centimeter, and the adhered portion in the example described above is present on three to four sides of the rectangular envelope, and therefore rollers longer than the width of the envelope have been necessary so that a pressure can be applied the entire surface of the envelope having a predetermined area (refer to FIG. 4 of patent document 1 mentioned above). If such pressure rollers are to be provided, the mechanical structure of the entire device must be robust. Such a device is a costly device consequently, and it has not been spread as an office installation device accordingly.

The present invention has been made in view of the objects as described above, and its object is to provide a sealed letter producing device for performing printing on the envelope sheet and content, and enclosing and sealing of the folded envelope sheet, in which sealing using a pressure-sensitive adhesive can be performed with a simple configuration using pressure rollers smaller than conventional ones.

Means for Solving the Problems

The inventors of the present invention obtained the above objects and examined various solutions to the objects, and considered using other adhesives than pressure-sensitive adhesives during the examination. In the present circumstances, some of few possible examples of adhesives cheaper than pressure-sensitive adhesives are remoistening pastes such as mucilage. In the case of remoistening pastes, application of water is necessary to develop adhesive strength. However, since the material forming an envelope is paper, when the paper contains water, a considerable reduction in rigidity and deformation of the paper occur due to swelling. Accordingly, adhesion using a remoistening paste such as mucilage can be used for simple adhesion between two sheets, but in the adhesion of three or four sheets such as production of a sealed letter performed by folding the envelope sheet to which the present invention is directed, swelling is markedly increased, which likely leads to the occurrence of the problems such as a significant reduction in rigidity and breakage. Moreover, since deformation of the paper sheet remains after drying, using a remoistening paste such as mucilage in an adhered portion of parts of the folded envelope sheet stacked in a plurality of layers is considered impossible as it is.

To this end, a sealed letter producing device according to the first aspect is a sealed letter producing device including: a printing unit which prints an envelope sheet which becomes an envelope and a content for each sealed letter to be produced; a first paper path which transfers the envelope sheet printed in the printing unit, a second paper path which transfers the content printed in the printing unit; and an enclosing and sealing unit which is disposed in a position where the first paper path and the second paper path merge, and produces a sealed letter by enclosing and sealing a content by folding the envelope sheet in a manner of containing the content, in which the enclosing and sealing unit includes a pressure bonding section which performs sealing by applying pressure on both edge portions in a width direction of the envelope intersecting its transfer direction provided therein.

The sealed letter producing device according to the second aspect is a sealed letter producing device according to the first aspect, wherein the enclosing and sealing unit includes an adhesion section which adheres the envelope sheet to the inside from both edge portions in the width direction of the envelope.

The sealed letter producing device according to the third aspect is the sealed letter producing device according to the second aspect, wherein each of the pressure bonding sections has a width smaller than an application width of pressure sensitive adhesives provided in both edge portions in the width direction of the envelope sheet and facing each other in both edge portions of the envelope, and has a pair of pressure rollers disposed at an interval greater than the size of the content in its width direction enclosed in the envelope, and smaller than the size of the envelope in its width direction.

The sealed letter producing device according to the fourth aspect is the sealed letter producing device according to the second or third aspect, wherein the adhesion section is a moistening section which moistens a remoistening paste provided inwardly of both edge portions in the width direction of the envelope sheet, in the enclosing and sealing unit, adheres the envelope sheet with the remoistening paste by folding the envelope sheet after the remoistening paste is moistened by the moistening section.

The sealed letter producing device according to the fifth aspect is the sealed letter producing device according to the fourth aspect, wherein in the enclosing and sealing unit, sealing is performed by applying pressure on both edge portions of the envelope in its width direction by the pair of pressure rollers after the envelope sheet is adhered with the remoistening paste by folding the envelope sheet after the remoistening paste is moistened by the moistening section.

An envelope sheet according to the sixth aspect is an envelope sheet applied to a sealed letter producing device including an enclosing and sealing unit which produces a sealed letter by enclosing and sealing a content by folding an envelope sheet in a manner of containing the content, wherein the envelope sheet has pressure sensitive adhesives which do not face each other when provided in its both edge portions in the width direction stacked in the same orientation, and which face each other in both edge portions of the envelope when formed on the envelope by folding, and another adhesive provided inwardly of the both edge portions in the width direction.

An envelope sheet according to the seventh aspect is an envelope sheet applied to a sealed letter producing device including an enclosing and sealing unit which produces a sealed letter by enclosing and sealing a content by folding an envelope sheet in a manner of containing the content, wherein the envelope sheet has a pressure sensitive adhesive provided only on one side in both edge portions in its width direction, notches provided in both edge portions of a side which becomes an inner side when bent, and another adhesive provided inwardly of the both edge portions in the width direction.

An envelope sheet according to the eighth aspect an envelope sheet applied to a sealed letter producing device including an enclosing and sealing unit which produces a sealed letter by enclosing and sealing a content by folding an envelope in a manner of containing a content, wherein the envelope sheet has an adhesive for adhering the envelope sheet which is bent and formed into the shape of an envelope, and an adhesive strength adjustment layer which is formed of an adhesion resistant material in a position corresponding to the adhesive in a predetermined pattern and adjusts adhesive strength of the adhesive for the envelope sheet.

An envelope sheet according to the ninth aspect is the envelope sheet according to the eighth aspect, wherein the adhesive strength adjustment layer has adhesion resistant portions where a front side of the envelope sheet is covered with the adhesion resistant materials, and adhered portions where the front side of the envelope sheet is not covered with the adhesion resistant materials, and the adhered portions are provided in a predetermined shape and in a plurality of portions.

An envelope sheet according to the tenth aspect is the envelope sheet according to the ninth aspect, wherein the adhesives and the adhesive strength adjustment layer are formed in different positions on the envelope sheet, and are configured to face each other when the envelope sheet is bent and formed into an envelope.

An envelope sheet according to the eleventh aspect is the envelope sheet according to the ninth aspect, wherein the other adhesive is provided on the adhesive strength adjustment layer, and the other adhesive is adhered to the front side of the envelope sheet via the adhered portion.

A sealed letter producing device according to the twelfth aspect is the sealed letter producing device according to the second aspect, wherein in the printing unit, a printing section which performs printing by an adhesion resistant material on the envelope sheet in a desired pattern is provided.

Effects of the Invention

According to the sealed letter producing device of the present invention, a common printing unit which performs printing on the envelope sheet and content prints and discharges an envelope sheet and a content alternately for each sealed letter to be produced. The printed envelope sheet is transferred through a dedicated first paper path, the printed content is transferred through a dedicated second paper path, the envelope sheet and content are precisely combined by an enclosing and sealing unit provided in a position where both paper paths merge, and the content is enclosed and sealed by folding the envelope sheet in a manner of containing a content, whereby a sealed letter can be produced.

According to the sealed letter producing device according to the first aspect, when a sealed letter is produced by folding an envelope sheet on which pressure-sensitive adhesives are provided only in both edge portions in the width direction, the entire surface of the envelope need not be pressurized in a step in the enclosing and sealing unit, and a pressure bonding section applies pressure only to both edge portions of the envelope in the width direction intersecting its transfer direction, whereby the pressure-sensitive adhesives in both edge portions of the envelope sheet in the width direction are pressurized to develop adhesive strength, so that sealing can be performed.

According to the sealed letter producing device according to the second aspect, in the sealed letter producing device according to the first aspect, in the enclosing and sealing unit, a portion inwardly of both edge portions in the width direction of the envelope can be adhered to the envelope sheet with an adhesion section which requires a pressure smaller than that required by than the pressure bonding section.

According to the sealed letter producing device according to the third aspect, in the sealed letter producing device according to the second aspect, the envelope sheet on which the pressure sensitive adhesives are provided in both edge portions in the width direction is folded, and when an envelope on which the pressure sensitive adhesives face each other in both edge portions is sealed, both edge portions of the envelope are pressurized and transferred using a pair of pressure rollers as the pressure bonding section, whereby only the pressure-sensitive adhesives on the envelope sheet can be pressurized and adhered surely without adhering the content in the envelope to the envelope, so that the envelope can be sealed.

According to the sealed letter producing device according to the fourth aspect, in the sealed letter producing device according to the second or third aspect, when the envelope sheet on which the remoistening paste is provided inwardly of both edge portions in its width direction is folded and sealed, the envelope can be sealed by using a moistening section as the adhesion section, applying water to the remoistening paste water to develop adhesive strength, then folding the envelope sheet, and adhering the envelope sheet securely with remoistening paste.

According to the sealed letter producing device according to the fifth aspect, in the sealed letter producing device according to the third or fourth aspect, in the enclosing and sealing unit, sealing can be performed by folding the envelope sheet after water is applied to the remoistening paste by the moistening section and applying pressure on both edge portions in the width direction of the envelope by a pair of pressure rollers after the envelope sheet is adhered with the remoistening paste.

According to the envelope sheet according to the sixth aspect, pressure sensitive adhesives are provided in such a pattern that they do not face each other when stacked in the same orientation in both edge portions in its width direction, but they face each other in both edge portions of the envelope when formed on the envelope by folding, and a pattern of another adhesive different from the pressure-sensitive adhesives provided on both edges is provided inwardly of both edge portions in the width direction of the envelope sheet, and it is therefore possible to perform sealing using the pressure-sensitive adhesives with a simple configuration using pressure rollers smaller than conventional ones by, for example, the sealed letter producing device according to the first to the fifth aspects.

According to the envelope sheet according to the seventh aspect, the pressure sensitive adhesives are provided only on one side of both edge portions in its width direction. Accordingly, the pressure sensitive adhesives do not face each other and are not adhered when stacked in the same orientation. Moreover, when formed on the envelope by folding, the pressure sensitive adhesives face each other directly in both edge portions of the envelope, or the pressure sensitive adhesives provided in both edge portions of one of the outer sides face the pressure sensitive adhesives provided in both edge portions of the other outer side via the notches provided in both edge portions bent to be an inside face. Moreover, inwardly of both edge portions in the width direction, another adhesive different from the pressure-sensitive adhesives is provided. It is therefore possible to perform sealing using the pressure-sensitive adhesives with a simple configuration using pressure rollers smaller than conventional ones by, for example, the sealed letter producing device according to the first to fifth aspects.

According to the envelope sheet according to the eighth aspect, an adhesive for adhering and sealing the envelope sheet which is bent and formed into the shape of an envelope is provided, and an adhesive strength adjustment layer made of an adhesion resistant material is provided in a position corresponding to this adhesive in a predetermined pattern. Since this adhesive adheres to the envelope sheet via the adhesive strength adjustment layer of a predetermined pattern, the adhesion area for the envelope sheet is restricted, and as a result, the adhesive strength for the envelope sheet can be set to a desired state. Therefore, ease of peeling required for opening and durability under the stress of handling required for mailing can be both achieved. Moreover, with the pressure sensitive adhesives provided in both edge portions in the width direction of the envelope, it is possible to perform sealing with a simple configuration using pressure rollers smaller than conventional ones.

According to the envelope sheet according to the ninth aspect, when the envelope sheet is bent and formed into the shape of an envelope, the adhesive forms an insufficient adhesion state which allows easy peeling for adhesion resistant portions of the adhesive strength adjustment layer, but forms adhesion with predetermined adhesive strength of the adhesive for the front side of the envelope sheet not covered with the adhesion resistant materials in the adhered portions. Since the adhered portions are provided in a predetermined shape and in a plurality of portions, they produce predetermined adhesive strength depending on their shape and area in the individual adhered portions, but the plurality of portions collectively develops the total adhesive strength of the individual portions.

According to the envelope sheet according to the tenth aspect, since it is so configured that the adhesive and adhesive strength adjustment layer are provided in different positions of the envelope sheet, the accuracy of positioning need not be set to a high level compared to the case where the adhesive and adhesive strength adjustment layer are stacked and formed and in the position on the envelope sheet, which allow easy production.

According to the envelope sheet according to the eleventh aspect, the adhesive is provided on the adhesive strength adjustment layer, and therefore it is possible to reserve a greater area of a region where the printed information can be read more easily in the entire area of the envelope sheet. Moreover, in the case of a configuration in which the adhesive is provided directly on the envelope sheet, the paper sheet may be possibly deformed in the process of developing adhesive strength depending on the type of the adhesive, but in this envelope sheet, the adhesive is provided on the adhesive strength adjustment layer, and therefore the force applied on the paper sheet is reduced in the process of developing the adhesive strength, so that the effects in reducing deformation of the paper sheet is obtained.

According to the sealed letter producing device according to the twelfth aspect, a common printing unit which performs printing on the envelope sheet and content prints and discharges an envelope sheet and a content alternately for each sealed letter to be produced. The printed envelope sheet is transferred through a dedicated first paper path, the printed content is transferred through a dedicated second paper path, the envelope sheet and content are precisely combined by an enclosing and sealing unit provided in a position where both paper paths merge, and the content is enclosed and sealed by folding the envelope sheet in a manner of containing a content, whereby a sealed letter can be produced.

According to the sealed letter producing device, the entire surface of the envelope need not be pressurized in a step in the enclosing and sealing unit, and the pressure bonding section applies pressure only to both edge portions of the envelope in the width direction intersecting its transfer direction, whereby the pressure-sensitive adhesives in both edge portions of the envelope sheet in the width direction are pressurized to develop adhesive strength, so that sealing can be performed.

Moreover, in enclosing and sealing unit, a portion inwardly of both edge portions in the width direction of the envelope can be adhered to the envelope sheet with an adhesion section which requires a pressure smaller than that required by than the pressure bonding section. In addition, the printing section provided in the printing unit allows printing on the envelope sheet with the adhesion resistant materials in a desired pattern, and therefore it can be used for production of the envelope sheet having the adhesive strength adjustment layer.

EXPLANATION OF REFERENCE NUMERALS

1—Sealed letter producing device
2—Printing unit
3—Enclosing and sealing unit
10—First paper path
11—One path of the first paper path
13—The other path of the first paper path
20—Second paper path
21—One path of the second paper path
26—The other path of the second paper path
30—Paper sheet
40—Content
50—Envelope
60—Moistening section as an adhesion section
80—Pressure roller as pressure bonding section
90—Control section
100, 100*a*, 100*b*, 100*c*, 200—Envelope sheet
106, 206—Pressure-sensitive adhesive
107, 207—Remoistening paste
A, A'—Main folding roller
B, B'—First folding roller
C—Second folding roller
D, D' . . . Paper transport roller
A"—Main folding roller
B"—First folding roller
C"—Second folding roller
D"—Paper transport roller

BEST MODE FOR CARRYING OUT THE INVENTION

1. First Embodiment (FIGS. 1 to 13)

(1) Sealed Letter Paper Sheet Used in this Sealed Letter Producing Device (FIGS. 1 to 5)

Figure 1:
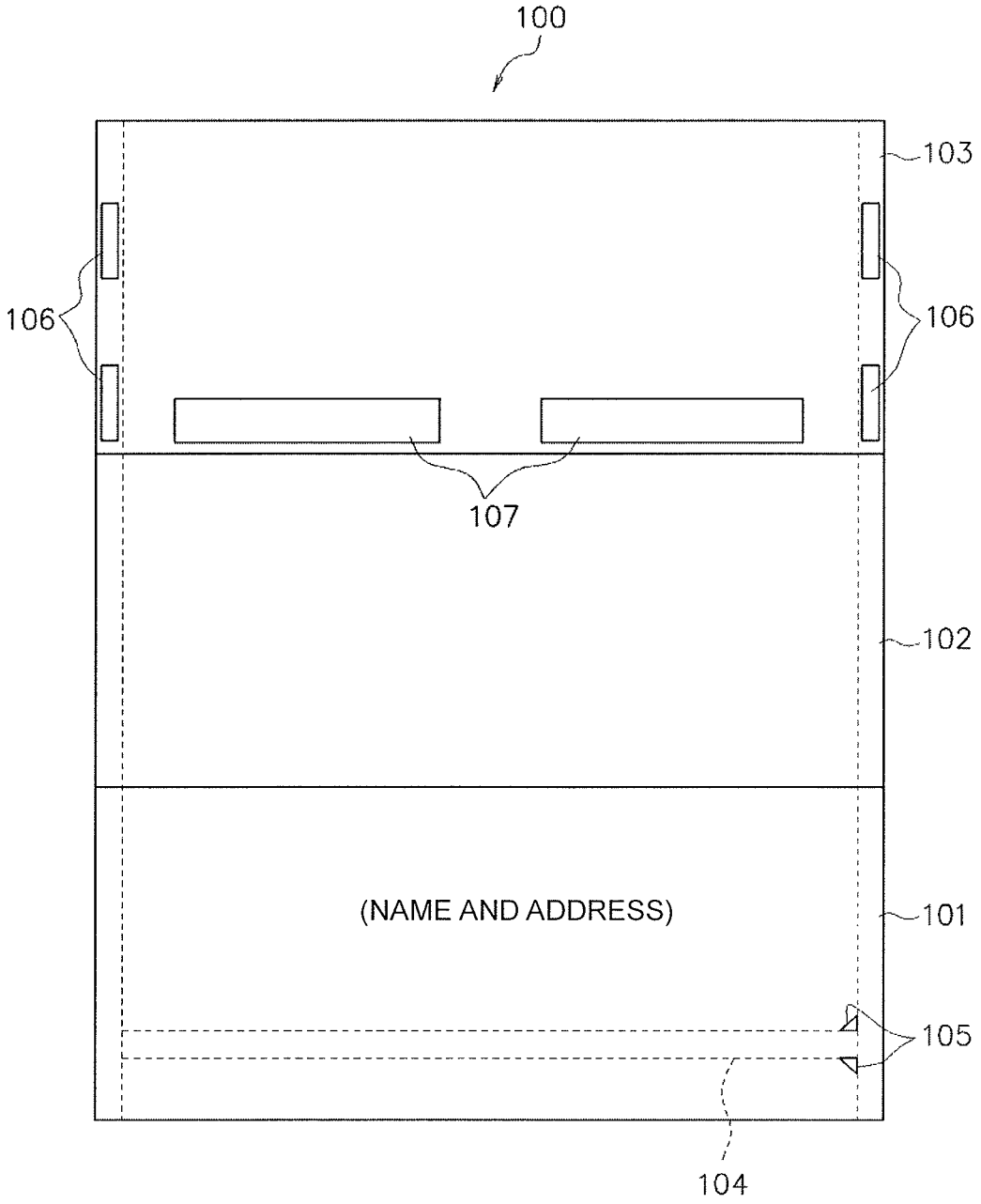
FIG. 1 A drawing of the surface of an envelope sheet according to the first embodiment.
Figure 2:
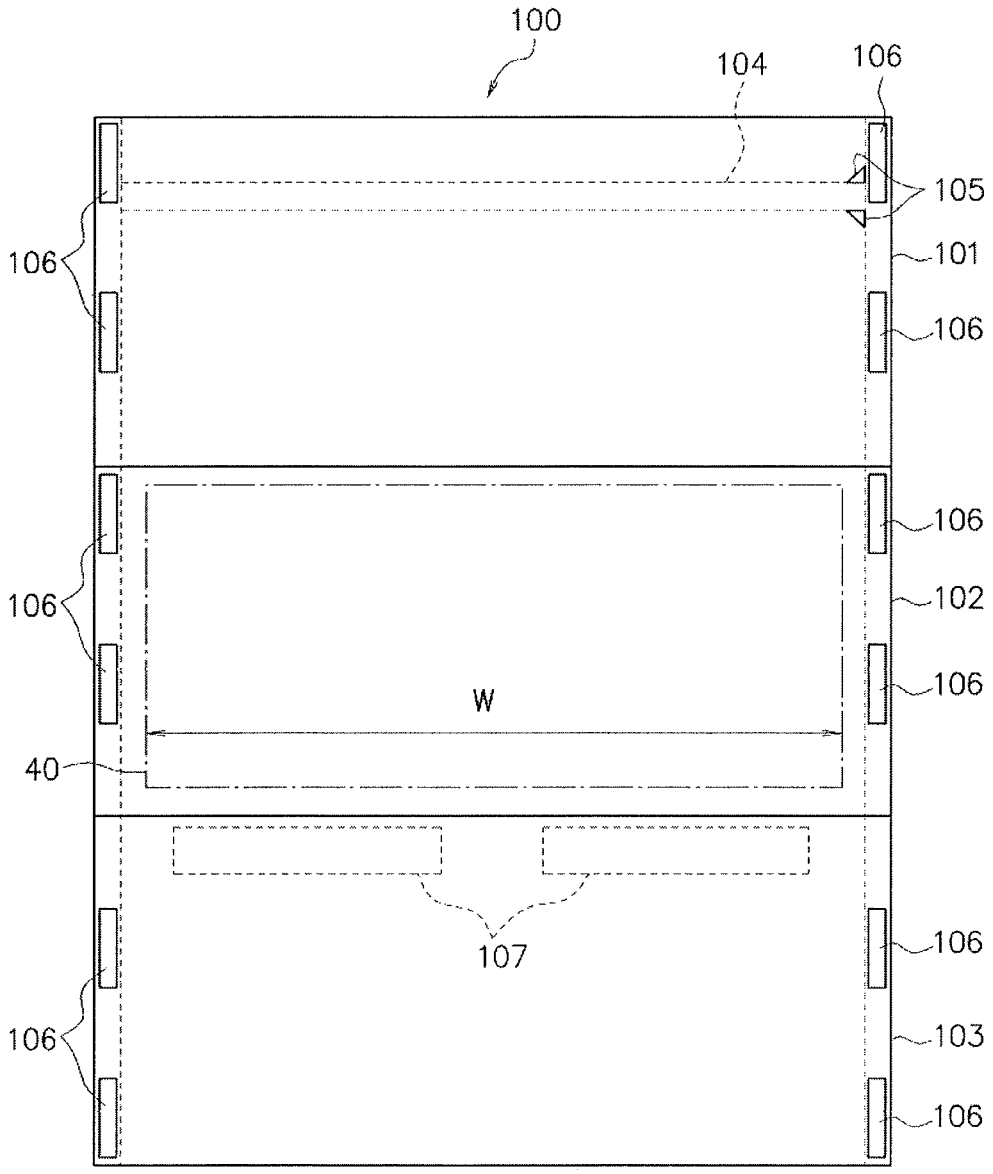
FIG. 2 A drawing of the back side of the envelope sheet according to the first embodiment FIG. 3 A drawing showing a folding step (1) of the envelope sheet according to the first embodiment.

FIG. 1 is a drawing which shows the surface (the side on which the name and address are printed) of an envelope sheet 100 used in this embodiment, while FIG. 2 is a drawing which shows the back side of the same. This envelope sheet 100 is a rectangular paper sheet including three paper pieces: a first paper piece 101, a second paper piece 102, and a third paper piece 103, which are connected by folds.

As shown in FIG. 1, the surface of the first paper piece 101 corresponds to the front side of the envelope, on which name and address are printed. The first paper piece 101 has a band-shaped opening tape 104 along its width direction formed thereon by perforation, and two openings 105 are provided at an end thereof. When the sealed envelope is opened, the opening tape 104 is torn off along the perforation by placing a finger on the opening tape 104 from this opening 105. The surface of the second paper piece 102 corresponds to the back side of the envelope, on which the name, address, etc. of the sender are printed. Pressure-sensitive adhesives 106 are provided in two portions along at a predetermined interval at both edge portions in the width direction on the surface of the third paper piece 103 in the form of bands. Moreover, on the surface of the third paper piece 103, two portions of remoistening pastes 107 are provided on the inner side of both edge portions close to the fold bordering the second paper piece 102 in a band-shaped pattern along the width direction.

A pressure-sensitive adhesive exhibits adhesive strength by adhering pressure-sensitive adhesives provided on two sheets of paper together and applying a predetermined pressure. Its known examples include two-pack type adhesive using microcapsules and natural rubber-based adhesion materials, among others. The remoistening paste is, for example, mucilage or the like. The remoistening paste has no adhesive strength when it is applied on paper and dry, but develops adhesive strength when wetted with water, and when the paper sheet is placed together with another paper sheet in this state and a required pressure is applied thereto, the two paper sheets are adhered. The pressure required for adhesion with a remoistening paste is effective even when it is significantly lower than the pressure required for a pressure-sensitive adhesive. Since their adhesive strengths are at least both considerably higher than that of paper, using two types of adhesives in a single envelope does not cause any problem due to a variation in the adhesive strength. Moreover, in place of the remoistening paste, an adhesive which does not normally have adhesive strength but develops adhesive strength by any operation other than the pressure as for the pressure-sensitive adhesive may be used. For example, adhesives which develop adhesive strength by heat, light including ultraviolet radiation, and other physical sections, other pressure-sensitive adhesives which develop adhesive strength with a pressure lower than that applied on the pressure-sensitive adhesive may be used.

The remoistening paste, as previously mentioned, requires application of water to develop adhesive strength. Since the material forming an envelope is paper, when the paper contains water, a considerable reduction in rigidity and deformation of the paper occur due to swelling. Moreover, since deformation of the paper sheet remains after drying, the appearance of the finished envelope is deteriorated. Therefore, deformation is minimized by divisionally placing a plurality of small sized portions of the remoistening paste within an adhesion area where the paste is required.

As shown in FIG. 2, on the surface of each of the first to third paper pieces 101 to 103, if necessary, the contents of the sealed letter, including the information such as text, graphics and photographs, can be printed. On the back side of each of the first to third paperpieces 101 to 103, the pressure-sensitive adhesives 106 are provided in two portions along both edge portions in the width direction at a predetermined interval. Moreover, a content 40 is mounted on the back side of the second paper piece 102. A width W of the content 40 is smaller than the interval between the pressure-sensitive adhesives 106 printed in both edge portions of the paper piece of the envelope sheet 100. The arrangement pattern of these pressure-sensitive adhesives 106 is so considered that the pressure-sensitive adhesives 106 of corresponding paper pieces meet and come into contact with each other when the paper pieces are folded to be assembled in the form of an envelope. However, for example, when a plurality of the envelope sheets 100 are stacked in the same vertical positional relationship, e.g., with their front sides facing up, the pressure-sensitive adhesives 106 on the front sides and the pressure-sensitive adhesives 106 on the back sides do not face each other to avoid contact therebetween. When the pressure-sensitive adhesives 106 are brought into contact with each other and left for a longperiod of time, the problem of natural adhesion of the adhesives may be caused by a high temperature, high humidity and other circumstances conditions even without any pressure, but such a problem can be prevented from occurring in advance according to the envelope sheet 100 of the embodiment.

After the name, address, contents, etc. are printed, the procedure of folding and other processes when the envelope sheet 100 is formed into an envelope will be described.

Figure 3:
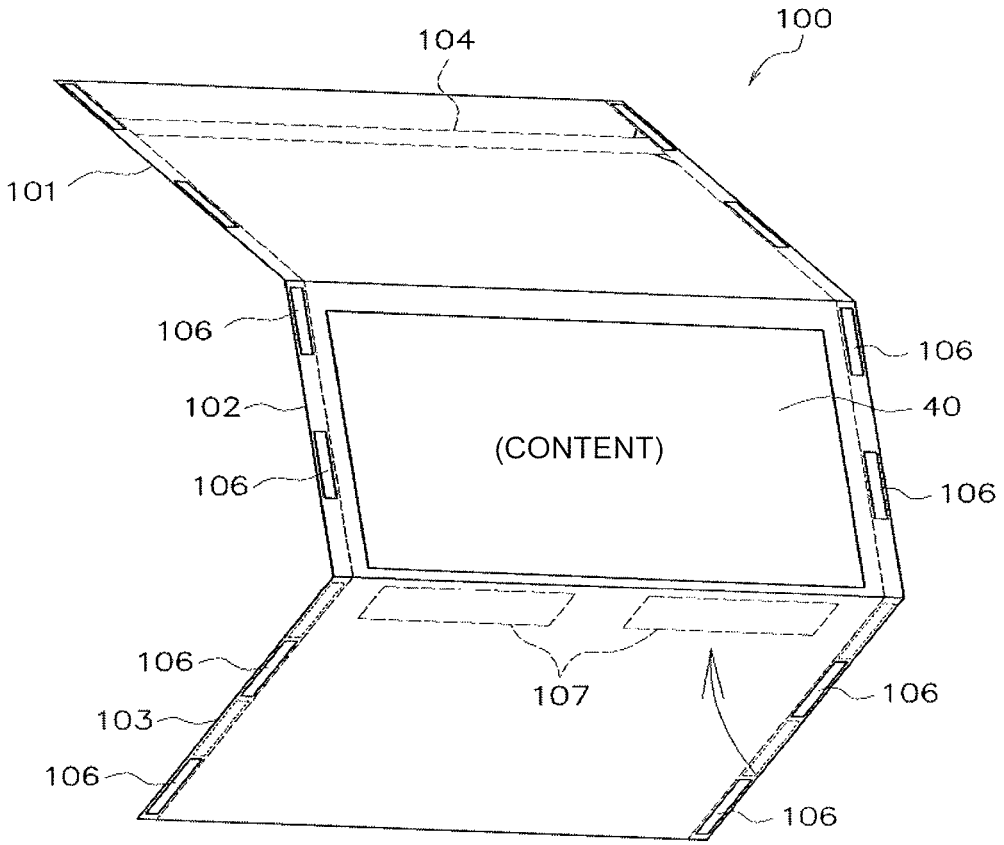
Figure 4:
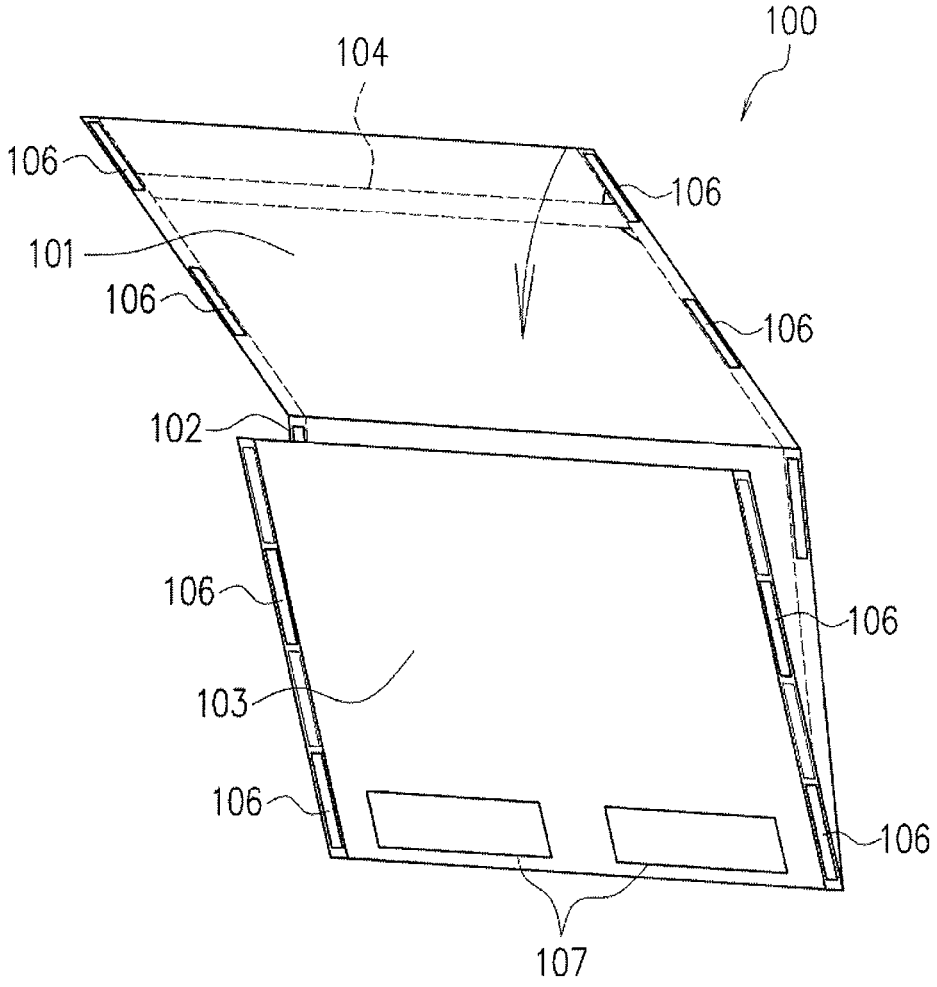
FIG. 4 A drawing showing a folding step (2) of the envelope sheet according to the first embodiment.

As shown in FIG. 3, in a state that the content 40 is mounted on the back side of the second paper piece 102, the back side of the third paper piece 103 is placed together with the second paper piece 102 and the content 40 to bring the pressure-sensitive adhesives 106 of both paper pieces 102, 103 into contact with each other. Further in FIG. 4, after water is applied onto the remoistening paste 107 by a section not shown, the back side of the first paper piece 101 and the front side of the third paper piece 103 of are put together to bring the remoistening paste 107 and the back side of the first paper piece 101 into contact, and the pressure-sensitive adhesives 106 of both paper pieces 101, 103 are brought into contact with each other. The envelope sheet 100 is in the form of an envelope folded in three in this state, but the pressure-sensitive adhesives 106 are yet adhered.

Figure 5:
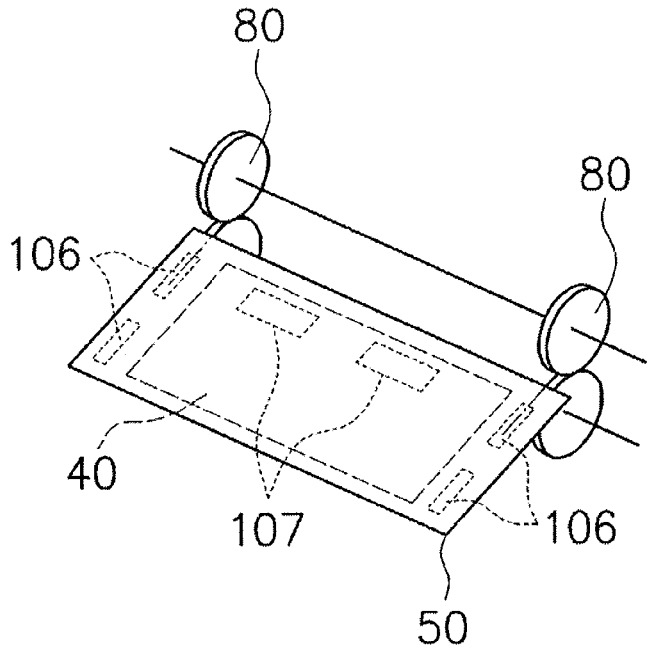
FIG. 5 A schematic perspective view showing a portion of the configuration of an enclosing and sealing unit in the sealed letter producing device of the first embodiment and the action of the same.

Thereafter, the entire surface of the envelope 50 is nipped by rollers not shown having a length equal to or greater than the width of the envelope to transfer the envelope 50, and the remoistening paste 107 of the third paper piece 103 and the first paper piece 101 are adhered. Moreover, as shown in FIG. 5, the pressure-sensitive adhesives 106 placed in both edge portions in the width direction of the envelope 50 are adhered by pressure rollers 80. A pair of these pressure rollers 80 includes upper and lower sets, and two left and right pairs of these rollers are provided. Thus, both edge portions in the width direction of the envelope 50 enclosing the content 40, that is, the direction intersecting the transfer direction are nipped from above and below and pressurized to develop the adhesive strength the pressure-sensitive adhesive 106 and achieve sealing. This produces the pressure-sensitive adhesives 106 which are in contact with each other between the paper pieces facing each other develops tackiness, the form of the envelope 50 sealing the content is realized.

It should be noted that the enclosing and sealing operation of the envelope sheet 100 described above is automatically performed by a sealed letter producing device 1 of the first embodiment described below.

(2) Mechanism of this Sealed Letter Producing Device (FIGS. 6 to 9)

The sealed letter producing device 1 of the first embodiment performs a process for each sealed letter to be produced. That is, required printing is performed in an appropriate order using a common printing unit 2 on the envelope sheet 100 and sheet-like paper sheet the content 40. Then, the envelope sheet 100 and the content 40 after printing are transferred into an enclosing and sealing unit 3, the envelope sheet 100 is folded so as to being the form of the envelope 50 while being transferred through the paper paths of different systems, and if necessary, the content 40 is also folded. Finally, both the envelope sheet 100 and the content 40 are merged at an enclosing and sealing section, and the content 40 is enclosed and sealed in the envelope 50 to be discharged in alignment as a finished sealed letter in an upper part of the device.

First, the sealed letter producing device 1 includes a printing unit 2 which prints and discharges the paper sheets which will be the envelope 50 and the content 40. This printing unit 2 is provided with a plurality of paper feed racks P (P1 to P4) which can accommodate more than one types of printed bodies (sheet-like paper sheet 30 which will be the content 40 and the envelope sheet 100) inside, on a side or other places of a cabinet 4 accommodates components of the device. In this example, the envelope sheet 100 is accommodated in a paper feed rack P1 attached to the side the cabinet 4, the sheet-like paper sheets 30 which will be the contents 40 are accommodated in paper feed racks P2 to P4 provided inside the cabinet 4.

Paper sheets and the like discharged from these paper feed racks P are transferred into a looped transfer path 5 from an introduction path to be transported, and an image is formed by printing section disposed at predetermined intervals downwardly along the lower half of the transfer path. In this example, four ink jet devices C, K, M and Y which discharge cyan, black, magenta and yellow inks, respectively, are disposed as printing section.

This looped transfer path 5 has a first discharge path 6 which discharges paper sheets to the outside of the loop in an approximately horizontal direction in a downstream adjacent portion of the printing section provided in a branching manner. Moreover, the upper half of the looped transfer path 5 has a second discharge path 7 which discharges paper sheets to the outside of the loop provided in a branching manner. In addition, a switchback path 8 is provided between the second discharge path 7 and the introduction path from the paper feed rack P in a branching manner. This switchback path 8 is a section which turns paper sheets upside down in the transfer path 5 by receiving the paper sheets transferred the transfer path 5 and then reverses the same to return to the transfer path 5. By turning the paper sheet upside down and passing through the transfer path 5 twice using this switchback path 8, full-color duplex printing for forming full-color images on both the front and back sides of on the paper sheet by the ink jet devices C, K, M and Y can be performed.

Next, adjacent to the printing unit 2, the enclosing and sealing unit 3 for receiving and processing the paper sheets 30 which will be the envelope sheets 100 and the contents 40 transferred from the first discharge path 6 of the printing unit 2, and enclosing and sealing the contents 40 in the envelope sheets 100 is provided.

That is, the first discharge path 6 of the printing unit 2 extends horizontally to protrude outwardly, and is introduced into a cabinet 9 of the enclosing and sealing unit 3 adjacent thereto. In the cabinet 9, a second paper path 20 branches obliquely downward from this discharge path 6, and extends obliquely downwardly to be one of a first paper path 10, a path 11, further downstream thereof.

The path 11, which is one of the first paper path 10, is disposed approximately in parallel to a path 21, which is one of the second paper path 20. The path 11, which is one of the first paper paths 10, is a guide path which transfers the envelope sheet 100 to a folding section, and as previously mentioned, and the path 21, which is one of the second paper paths 20, is a guide path which transfers the paper sheet of the content 40 to the folding section. The switching between the first and second paper paths 10 and 20 is performed by a switching flap not shown provided at the junction of the second paper path 20.

At an end of the path 11, which is one of the first paper path 10, a first folding section which folds the envelope sheet 100 to produce the form of the envelope 50 is provided. This first folding section is provided with a freely rotatable main folding roller A', a paper transport roller D' and a first folding roller B' which are in contact with the same and are rotated are provided. These rollers are made of rubber, and their pressurizing abilities are low since they are for folding paper sheets. Their lengths in the axial direction are greater than the width of the envelope sheet 100.

From between the main folding roller A' and the first folding roller B' in the first folding section of the first paper path 10, a path 13, which is the other path of the first paper path 10, curves in a convex shape upwardly and extends in the horizontal direction. An end of the path 13, which is the other path of the first paper path 10 which transfers the envelope sheet 100, leads to an enclosing and sealing section as will be described later in detail.

Next, the second paper path 20 which transfers the paper sheet printed by the printing unit 2 is provided inside the cabinet 9 of the enclosing and sealing unit 3. This second paper path 20 is positioned below the first paper path 10, and has the path 21, which is one of the paths for obliquely downwardly transferring the paper sheet transferred in the horizontal direction from the first discharge path 6 of the printing unit 2.

In the course of this path 21, a paper transport roller 22 and an alignment portion 23 which is a freely openable and closable gate are provided, so that the paper sheets can be stacked and retained in the path 21 by fixing the transferred paper sheets on the alignment portion 23 closing the path 21. Moreover, a folding section which folds the paper sheets is provided at an end of this path 21. This folding section is provided with a freely rotatable central main folding roller A, and furthermore, a first folding roller B, a second folding roller C and a single paper transport roller D are in contact with a main folding roller A, each of the rollers being freely rotatable. These rollers are made of rubber, their pressurizing abilities are low since they are for folding paper sheets, and their lengths in the axial direction are greater than the width of the envelope sheet 100. In addition, although not shown, in a front position in the direction of transfer by the main folding roller A and the transport roller D, an impinging member on which the front end of the transferred paper sheet impinges is provided, so that the impinging paper sheet is warped and the warped portion of the paper sheet is led in between the main folding roller A and folding roller B to fold the paper sheet. Similarly, an impinging member is also provided in a front position in the transfer direction by the main folding roller A and folding roller B, so that the impinging paper sheet is warped the warped portion of the paper sheet is led in between the main folding roller A and folding roller C to fold the paper sheet. Therefore, according to these folding section, the paper sheet can be folded twice or more.

In the cabinet 9 of the enclosing and sealing unit 3, the second paper path 20 has the other path 26 which continuously transfers the paper sheet 30 folded by the folding section obliquely upwardly, i.e., approximately perpendicularly to the path 21. This other path 26 is positioned below the above-mentioned path 13, i.e., the other path of the first paper path 10, which transfers the envelope sheet 100 obliquely downward, and joins the path 13 of the first paper path 10 at the enclosing and sealing section.

Next, the enclosing and sealing section positioned at the junction between the first paper path 10 and the second paper path 20 will be described. This enclosing and sealing section is a second folding section which provides further folding with the envelope sheet 100, if necessary, while, at the same time, it is an enclosing section which encloses the content 40 in the envelope by providing the envelope sheet 100 with further folding after the content 40 is aligned with the folded envelope sheet 100, and is further provided with a sealing section which seals this envelope.

First, the enclosing and sealing section is provided with the second folding section, i.e., a freely rotatable main folding roller A", a paper transport roller D" which is in contact with and rotated by the same, and first and second folding rollers B", C". These rollers are made of rubber. Their pressurizing abilities are low since they are for folding paper sheets, and their lengths in the axial direction are greater than the width of the envelope sheet 100. The envelope sheet 100 is folded, if necessary, by the main folding roller A', first folding roller B' and other components which are the above-mentioned first folding section, and then transferred further to the main folding roller A" and other components, which the second folding section, where pre-enclosure folding, if necessary, is further performed.

However, as will be described later in detail, the envelope sheet 100 is folded in three to enclose the content 40 therein enclose in this embodiment. Therefore after the envelope sheet 100 is folded once by the main folding roller A', first folding roller B' and other component which are the first folding section, passes between the main folding roller A" and paper transport roller D", which are the second folding section, and then stands by for the alignment with the content 40 around where it has passed between the main folding roller A" and second folding roller B". After the envelope 50 is then aligned with the content 40 transferred through the second paper path 20, it is provided with the second folding further between the main folding roller A" and second folding roller C", and enclosing of the content 40 into the envelope 50 is performed.

However, in this embodiment, a standby path 46 extends downwardly from between the main folding roller A" and paper transport roller D". Accordingly, production of sealed letters can be also performed for envelope sheets different from that in this embodiment or steps different from that in this embodiment. For example, after an envelope sheet is folded once by the main folding roller A', the first folding roller B' and other components which are the first folding section, the envelope sheet is passed between the main folding roller A" and paper transport roller D" which are the second folding section, and is caused to enter the standby path 46 in that state and put on standby. Thereafter, after a content transferred through the second paper path 20 is aligned with this envelope sheet during standby, both can be nipped between the main folding roller A" and second folding roller B", and transferred while being folded to enclose the content in the envelope.

Next, as shown in FIGS. 6 to 8 and FIG. 9, a path 31 slightly inclined to the back is disposed between the main folding roller A" and second folding roller C" of the enclosing and sealing section. Around the rear end of this path 31, a moistening section 60 as an adhesion section which applies water to the remoistening paste 107 of the envelope sheet 100 to develop adhesive strength, and adheres the envelope sheet 100 to form the envelope 50 is provided.

The moistening section 60 is a device for moistening the remoistening paste 107 provided inwardly of both edge portions of the width direction of the envelope sheet 100.

The moistening section 60 is provided with a water tank 61 which is disposed below the path 31, a water-absorbing portion 62 which is immersed into water in the water tank 61 and is made from a felt material or the like, a swing arm 63 disposed above the path 31, and a rotation cam 64 which drives this swing arm 63.

The envelope sheet 100 which is folded once by the main folding roller A', the first folding roller B' and other components which are the first folding section passes between the main folding roller A" and paper transport roller D", which are the second folding section, and then stands by around where it has passed between the main folding roller A" and second folding roller B". Thereafter, the content 40 transferred along the path 26, which is another second paper path 20 is aligned with the envelope sheet 100 during standby.

Figure 10:
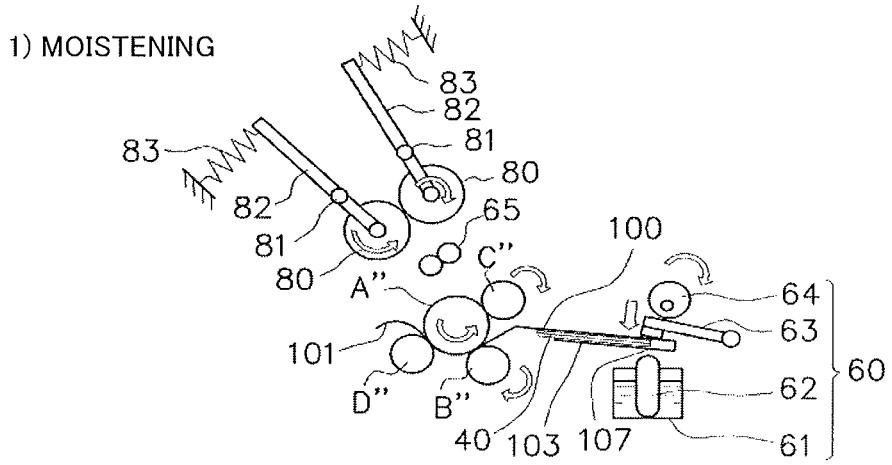
FIG. 10 A schematic front view showing a moistening step of a remoistening paste in the enclosing and sealing unit of the sealed letter producing device of the first embodiment.

As shown in FIG. 10, the aligned envelope sheet 100 and content 40 are further forwarded by the main folding roller A" and second folding roller B". Herein, in the envelope sheet 100, the front side of the third paper piece 103 faces down, and the remoistening paste 107 on the front side of the third paper piece 103 faces the water-absorbing portion 62 of the moistening section 60. This is close to the state of the first paper piece 101 before it is folded in the direction of the arrow in FIG. 4. The rotation cam 64 is activated herein to swing the swing arm 63, and the remoistening paste 107 is pressed against the water-absorbing portion 62 to be moistened.

Figure 11:
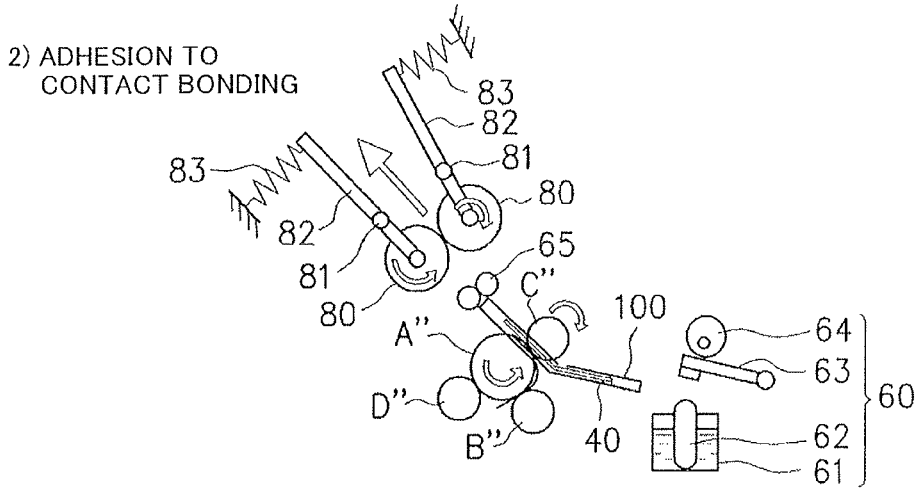
FIG. 11 A schematic front view showing an adhesion step with the remoistening paste in the enclosing and sealing unit of the sealed letter producing device of the first embodiment.

As shown in FIG. 11, the envelope sheet 100 is forwarded by the main folding roller A" and second folding roller C". This causes the first paper piece 101 to be folded, overlapped with the front side of the third paper piece 103, and adhered to the remoistening paste 107.

Next, as shown in FIGS. 6 to 8 and FIG. 9, a path 47 inclined obliquely forwardly is disposed between the main folding roller A" and second folding roller C" of the enclosing and sealing section. This path 47 is approximately parallel to the path 11 which is one of the first paper paths 10, and the path 21, which is one of the second paper paths 20.

In the course of this path 47, as has already been described with reference to FIG. 5, pressure rollers 80 as a pressure bonding section constituting a portion of the enclosing and sealing section is provided. Since the pressure rollers 80 is a section which applies a certain level of pressure the pressure-sensitive adhesive 106 of the envelope sheet 100, it is constituted by a highly rigid metal. A set of these pressure rollers 80 includes upper and lower sets of rollers, and two left and right pairs are provided. The pressure rollers 80 nip each of the edge portions of the envelope 50 in the width direction thereof in which the content 40 is enclosed from above and below to apply pressure thereon, whereby sealing by the pressure-sensitive adhesive 106 can be performed.

Figure 9:
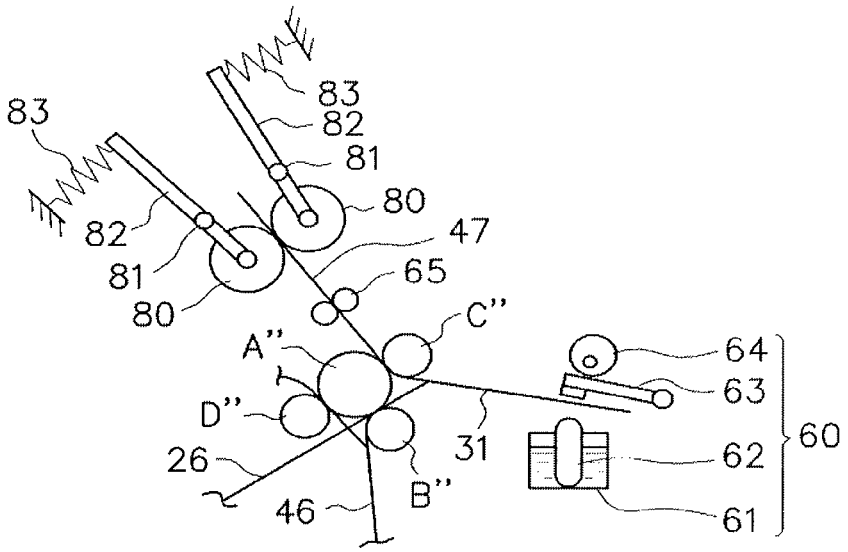
FIG. 9 A schematic front view showing the configuration of the enclosing and sealing unit in the sealed letter producing device of the first embodiment.

As shown in FIG. 9, each of the pressure rollers 80 is attached to at the front end of a support arm 82 caused to be swingable about a fulcrum 81. A biasing section 83 is attached to the rear end of this support arm 82, a set of the pressure rollers 80 are configured to come into contact with each other at a predetermined pressure. Therefore, by guiding the envelope 50 to go between a set of the pressure rollers 80, 80, and driving in the direction of transfer the pressure rollers 80, the envelope 50 is forwarded under the predetermined pressure of both edge portions. It should be noted that the pressure applied to the envelope sheet 100 by the pressure rollers 80 due to the biasing section 83 depends on the type of the pressure-sensitive adhesive 106, but may be, for example, about 700 N/cm$^2$.

Herein, the width of the pressure rollers 80 is less than the width of application of a pressure sensitive adhesive provided in both edge portions of the width direction of the envelope sheet 100. Moreover, the interval between the left and right pairs of the pressure rollers 80, 80 is greater than the width of the content 40 enclosed in the envelope 50, and is less than the width of the envelope 50. Therefore, in a sealing step by the pressure rollers 80 only the pressure-sensitive adhesive 106 in both edge portions of the envelope 50 in the width direction can be adhered by planned pressurizing surely with an area equivalent to the width of the pressure rollers 80, and at that time, the content 40 is not pressurized by the pressure rollers 80, and therefore the content 40 is not adhered to the envelope. As an example, when an envelope of a normal size is formed, the width of the pressure-sensitive adhesives 106 provided in both edge portions of the envelope sheet 100 may be about 5 mm in consideration of a positional shift of the pressure rollers 80, while the width of the pressure rollers 80 may be about 3 mm in consideration of secured adhesion of the envelope sheet 100.

As described above, the widths of the pressure rollers 80 are small, and only the portions of the pressure-sensitive adhesive 106 in both edge portions of an assembled envelope need to be nipped and pressurized by the pressure rollers 80, and therefore positioning in the width direction of the envelope with respect to the pressure rollers 80 needs to be correctly performed.

Figure 12:
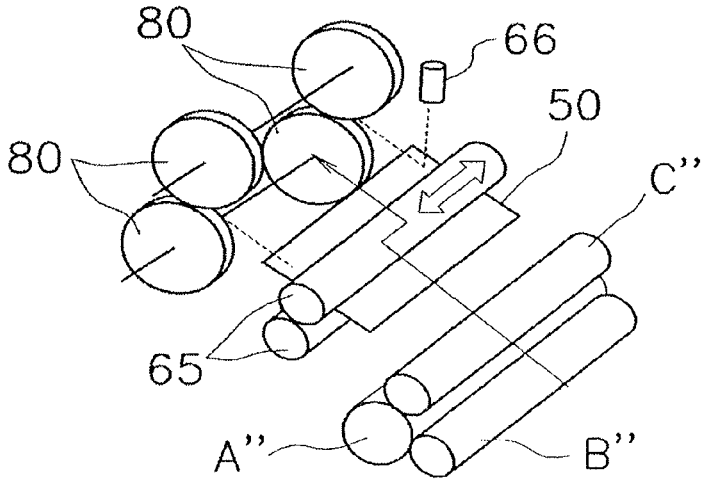
FIG. 12 A schematic perspective view showing especially a positioning mechanism of the envelope in the enclosing and sealing unit of the sealed letter producing device of the first embodiment.

To this end, as shown in FIG. 12, a positioning roller 65 is provided between the main folding roller A" and second folding roller C" and the pressure rollers 80 in the enclosing and sealing unit of this embodiment. The length of the positioning roller 65 in the axial direction of is greater than the width of the envelope sheet 100, and therefore can move in the axial direction with the envelope sheet 100 left nipped therebetween to adjust the position. Moreover, an edge sensor 66 is provided above a portion slightly downstream of the positioning roller 65, enabling capturing the edge portions of the envelope sheet 100 nipped by the positioning roller 65, and obtaining the positional information of the envelope sheet 100 to correct the position of the positioning roller 65.

Figure 13:
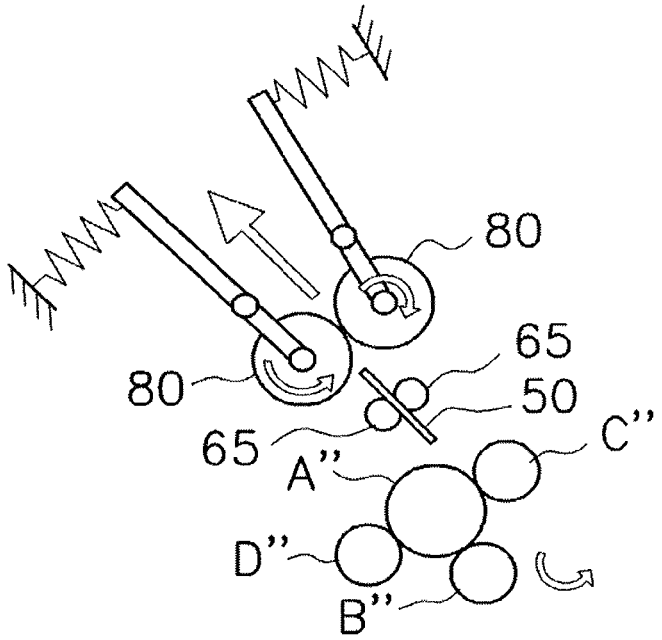
FIG. 13 A schematic perspective view showing the action of the positioning mechanism of the envelope in the enclosing and sealing unit of the sealed letter producing device of the first embodiment.

Therefore, as shown in FIG. 12 or 13, by causing the edge sensor 66 to capture the edge portion of the envelope 50 which is being transferred by the positioning roller 65, and moving the positioning roller 65 based on the position information, the position of the envelope 50 in the width direction relative to the pressure rollers 80 can be optimally adjusted. Accordingly, only the portions of the pressure-sensitive adhesives 106 in both edge portions of the assembled envelope 50 can be surely pressurized by the pressure rollers 80.

Figure 6:
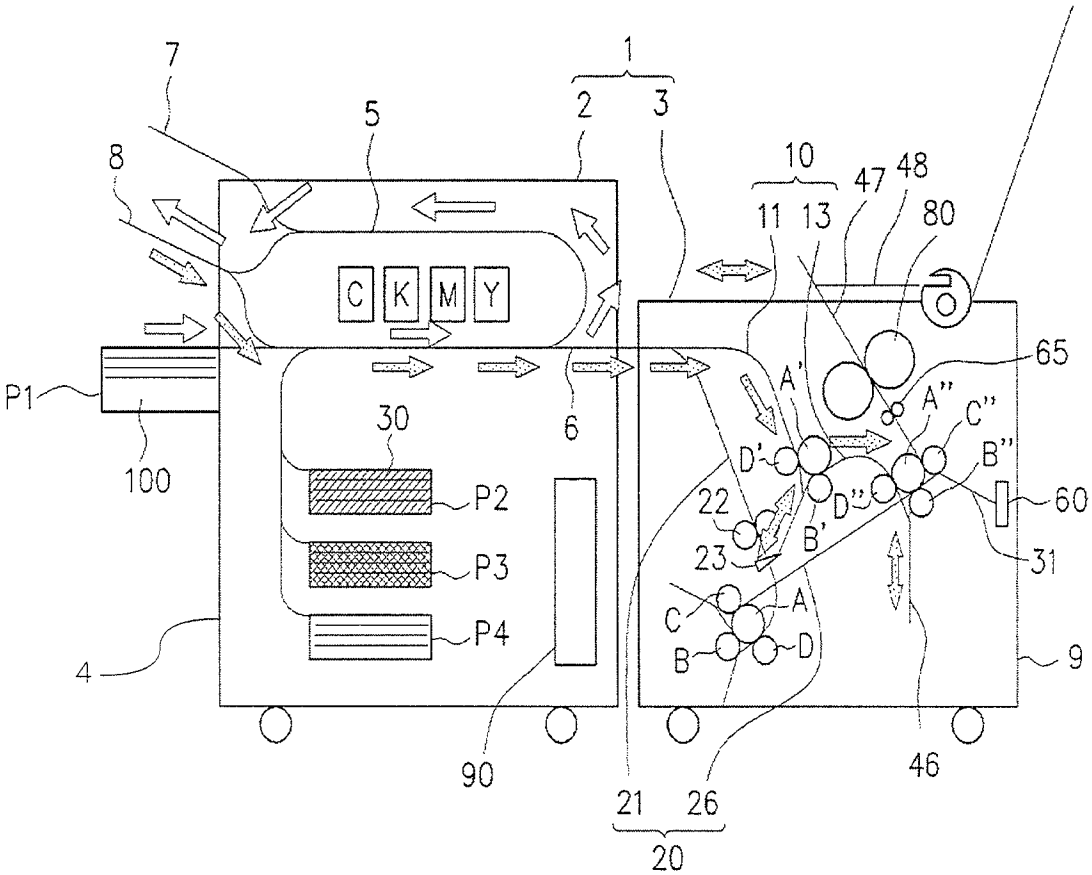
FIG. 6 A schematic cross-sectional view showing the structure of the sealed letter producing device according to the first embodiment, and the flow of an envelope in the device by arrows.
Figure 7:
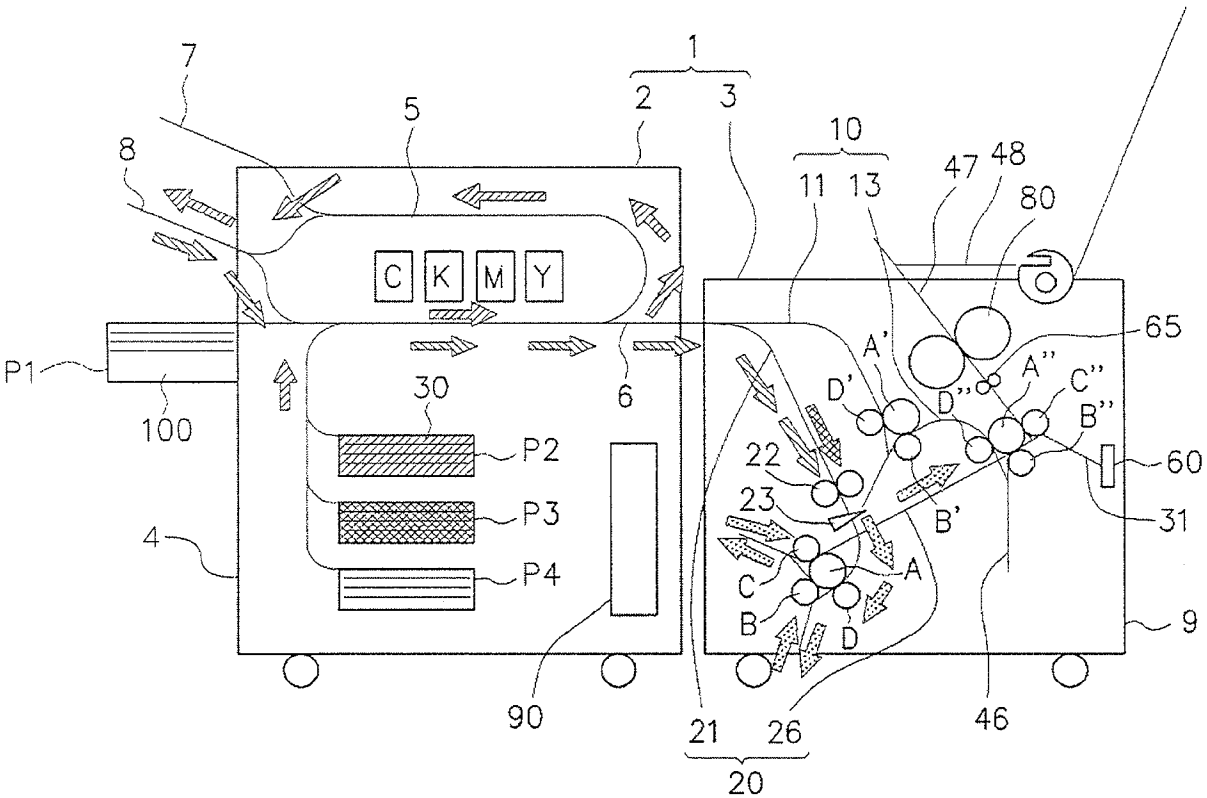
FIG. 7 A schematic cross-sectional view showing the structure of the sealed letter producing device according to the first embodiment, and the flow of a content in the device by arrows.
Figure 8:
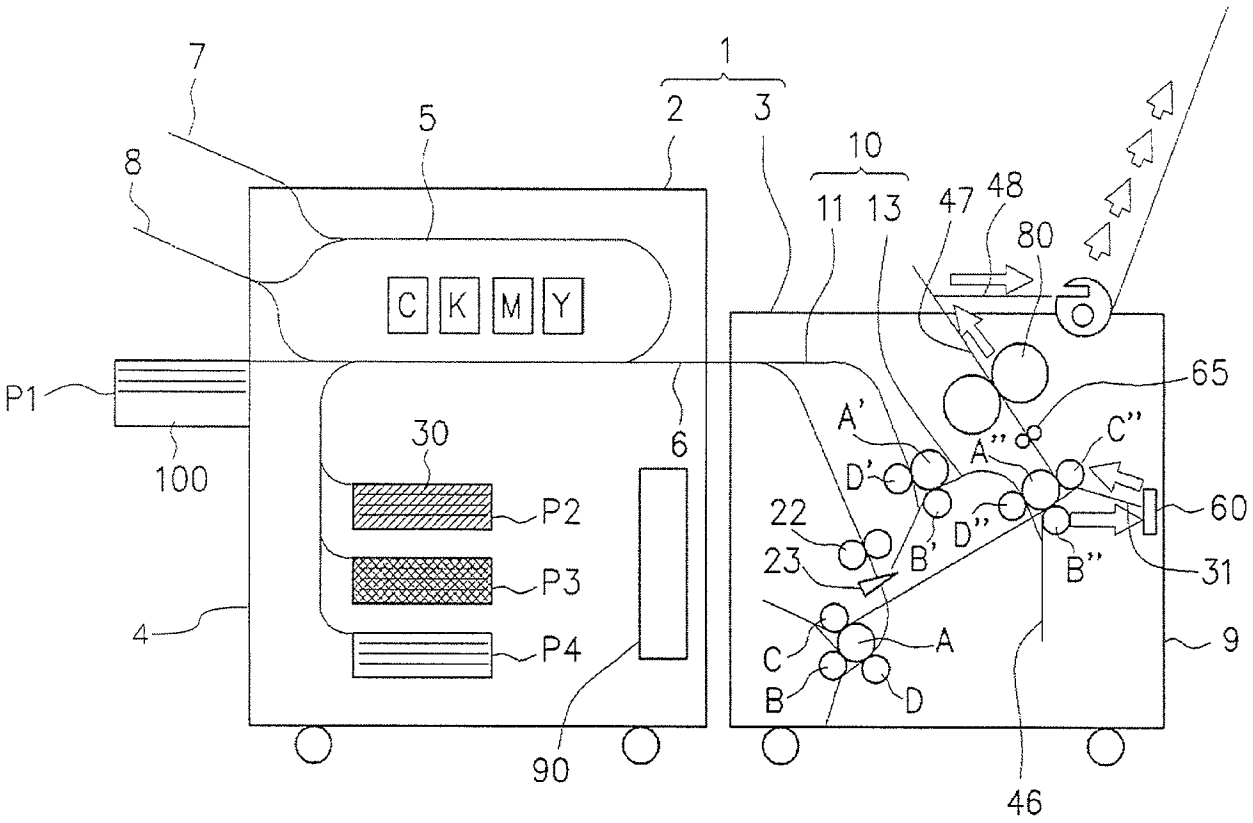
FIG. 8 A schematic cross-sectional view showing the structure of the sealed letter producing device according to the first embodiment, a sealing operation and a discharge step of the envelope after the sealing in the device.

It should be noted that as shown in FIGS. 6 to 8, the sealed letter producing device 1 of this embodiment is provided with a control section 90 which controls each mechanism of the printing unit 2 and enclosing and sealing unit 3 described above. It should be noted that in the example illustrated, the control section 90 is disposed in the printing unit 2, but it may be disposed in the enclosing and sealing unit 3, or may be separately disposed outside the printing unit 2 and the enclosing and sealing unit 3.

(3) Operation of this Sealed Letter Producing Device (FIGS. 6 to 8, FIGS. 10 to 13)

Next, in the sealed letter producing device 1 of this embodiment described above, the overall procedure including printing of name and address and other information on the envelope sheet 100, performing required printing on a plurality of sheets of the content 40 and folding the same, enclosing the content 40 in the envelope 50 which is the folded and formed envelope sheet 100 and sealing the envelope 50 will be described.

As shown in FIG. 6, in the printing unit 2, the envelope sheet 100 is transferred from the paper feed rack P1. In this embodiment, the envelope sheet 100 may be on any of the paper feed racks P1 to P4 of the printing unit 2. This envelope sheet 100 is printed on it both sides by the ink jet devices C, K, M, Y during a single pass around the looped transfer path 5. Not only duplex printing but also simplex printing can be selected. In general, name, address and other information are printed on the face which serves as the outer face of the envelope 50, while any information to be sent to the address, if necessary, is printed on the face which serves as the inner face of the envelope 50, along with particulars of the enclosed content 40. The information printed on the inner face of the envelope 50 can be read by a receiver by cutting and opening the envelope 50.

The envelope sheet 100 is transferred from the path 11, which is one of the first paper paths 10, by switching of a switching flap not shown to the folding section. The envelope sheet 100 is forwarded by the main folding roller A' and the paper transport roller D', impinges on an impinging member not shown to be warped, enters in between the main folding roller A' and the first folding roller B' from the warped portion, and further nipped and transferred to be provided with a fold in a portion of the front end portion thereof in the paper feed direction. The unfinished envelope which is partially folded passes between the main folding roller A" and paper transport roller D" of the enclosing and sealing section, further simply passes between the main folding roller A" and second folding roller B" along the path, and then stands by for the alignment with the content 40.

As shown in FIG. 7, following the envelope sheet 100, the required paper sheet 30 is transferred as the content 40 from any of the paper feed racks P2 to P4 into the looped transfer path 5 at a certain determined interval, both sides of the paper sheet 30 are printed by the ink jet devices C, K, M and Y during a single pass through this transfer path. Not only duplex printing but also simplex printing can be selected. The paper sheet 30 of the content 40 is transferred to the path 21, which is one of the second paper paths 20, by switching of a switching flap not shown. The paper sheet 30 is retained at an alignment portion 23 on the path 21, which is one of the second paper paths 20 until a required number of sheets are accumulated, the alignment portion 23 opens when the required number is accumulated and the sheets are transferred into the folding section (main folding roller A, etc.). A plurality of folding performed by the folding section, the paper sheet 30 folded in a desired state is transferred into the enclosing and sealing unit (main folding roller A", etc.) via the path 26, which is the other path of the second paper paths 20. In this embodiment, the content 40 is folded inwardly in three. This content 40 is forwarded by the main folding roller A" and second folding roller B", and is aligned with the envelope sheet 100 which is on standby near these rollers.

As shown in FIG. 8, an operation to bend the envelope sheet 100 is performed in a manner of wrapping up the content 40 with the envelope sheet 100 being outside by the main folding roller A" and second folding roller C" in the enclosing and sealing unit, and whereby an enclosing step for wrapping up the paper sheet 30 within the envelope 50 is performed.

As shown in FIG. 10, the aligned envelope sheet 100 and content 40 are further forwarded by the main folding roller A" and second folding roller B". Herein, the rotation cam 64 of the moistening section 60 is activated to swing the swing arm 63, and the remoistening paste 107 of the envelope sheet 100 is pressed against the water-absorbing portion 62 to be moistened.

As shown in FIG. 11, the envelope sheet 100 is forwarded by the main folding roller A" second folding roller C", the first paper piece 101 is folded and is adhered to the front side of the third paper piece 103 with the remoistening paste 107 to be in the shape of the envelope 50, and enters in between the positioning rollers 65.

As shown in FIG. 13, the positioning rollers 65 nipping the envelope 50 adjusts the position of the envelope 50 in the axial direction based on the position of the envelope 50 grasped by the edge sensor 66 shown in FIG. 12, and the envelope 50 is moved to bring the pressure-sensitive adhesives 106 on the envelope 50 to a position overlapping the pressure rollers 80. In addition, both edge portions of the envelope 50 are stuck together as it passes through the pressure rollers 80, whereby sealing of the envelope 50 is performed.

According to this embodiment, in the process of folding the envelope sheet 100 aligned with the content 40 to form into the envelope 50, paper pieces are adhered to each other with the remoistening paste 107 first, the positioning of the envelope 50 in the width direction is accurately performed and is then transferred in between the pressure rollers 80, the pressure-sensitive adhesives 106 are pressurized securely by the pressure rollers 80 having a small width. Therefore, the pressure-sensitive adhesives 106 can be securely adhered with a width sufficient for adhesion by the pressure rollers 80 which have a small width and can produce high pressure with a small force.

Then, the finished sealed letter after the completion of enclosing and sealing is discharged into a discharge tray 48 provided on the top surface of the cabinet 9, where it is sequentially stacked up to be taken out later.

2. Second Embodiment (FIGS. 14 to 17)

Figure 14:
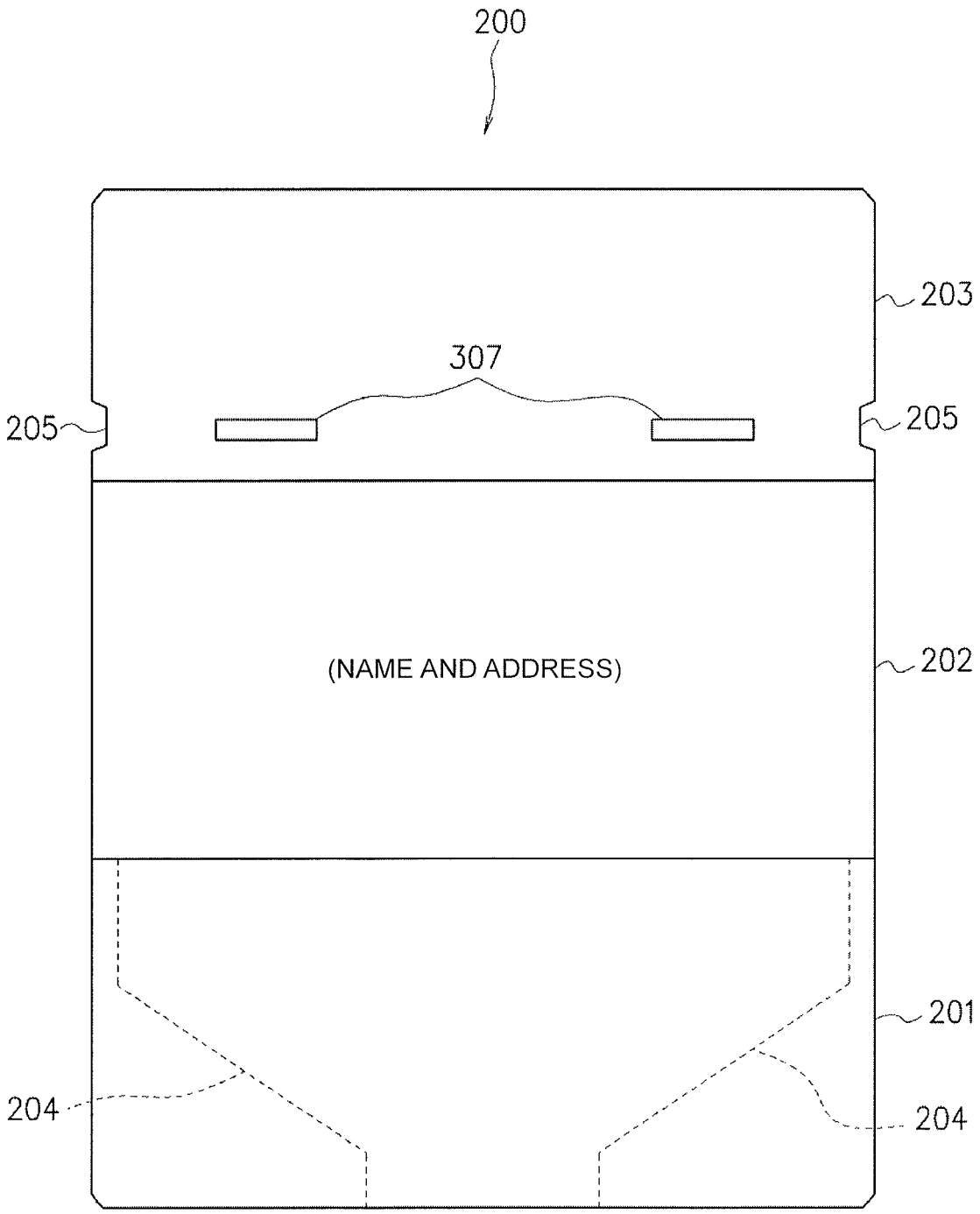
FIG. 14 A drawing of the surface of the envelope sheet according to the second embodiment.

FIG. 14 is a drawing which shows the front side (the side on which the name and address are printed) of an envelope sheet 200 used in this embodiment, while FIG. 2 is a drawing which shows the back side of the same. This envelope sheet 200 is a rectangular paper sheet including three paper pieces: a first paper piece 201, a second paper piece 202, and a third paper piece 203, which are connected by folds.

As shown in FIG. 14, the front side of the first paper piece 201 corresponds to the back side of the envelope, on which the name, address, etc. of the sender are printed. On the first paper piece 201, two perforations 204 are formed from a long side parallel to the folds to reach both edge portions in the width direction. When the sealed envelope is opened, the central portion of the first paper piece 201 may be torn off along these perforations 204. The surface of the second paper piece 202 corresponds to the front side of the envelope, on which the name and address are printed. On the surface of the third paper piece 203, two portions of remoistening pastes 307 are provided on the inner side of both edge portions close to the fold bordering the second paper piece 202 in a band-shaped pattern along the width direction. Among both edge portions of the third paper piece 203, a notch 205 is provided in the portion closer to the second paper piece 202.

Figure 15:
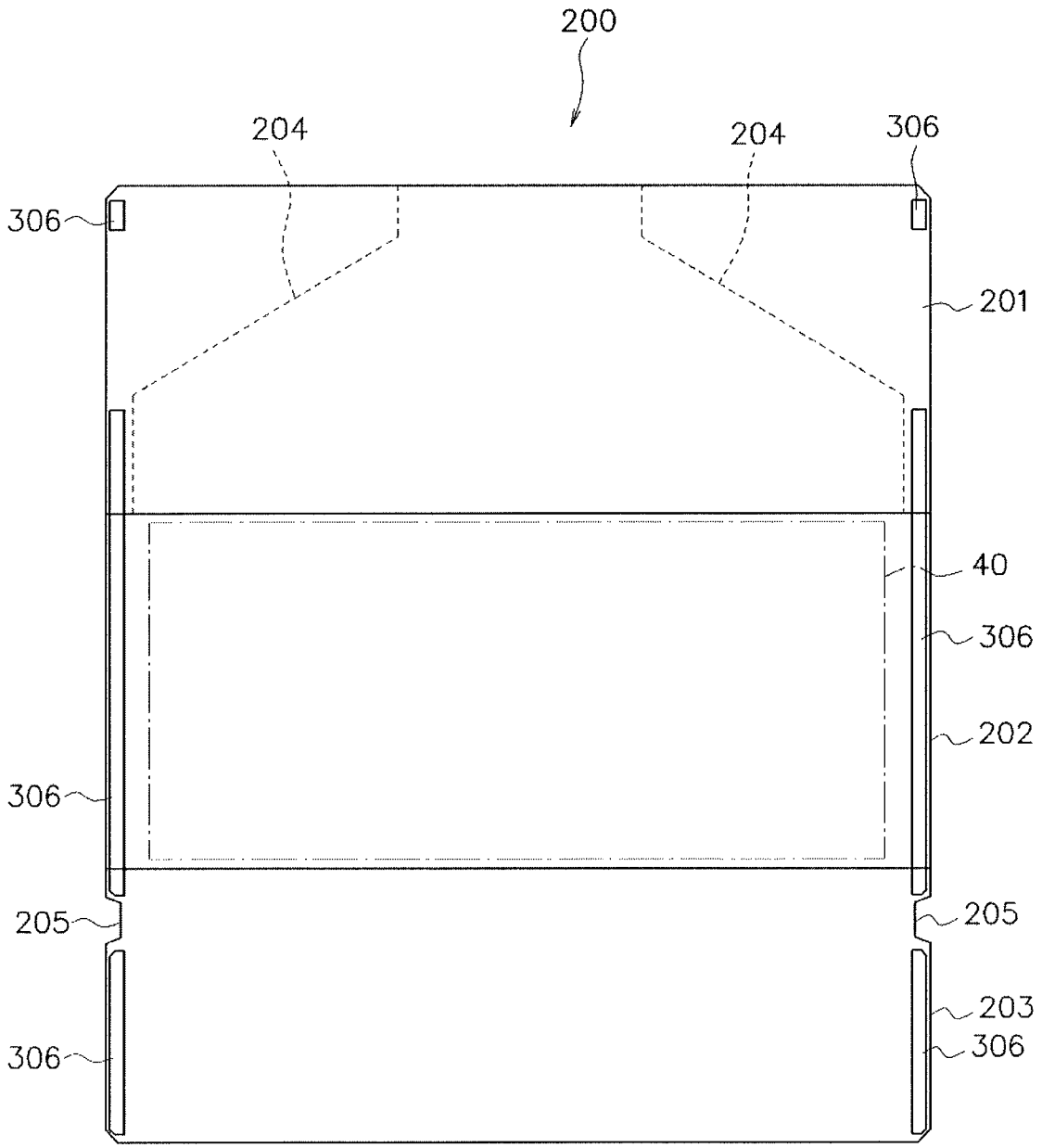
FIG. 15 A drawing of the back side of the envelope sheet according to the second embodiment FIG. 16 A drawing showing a folding step (1) of the envelope sheet according to the second embodiment.

As shown in FIG. 15, on the back side of each of the first to third paper pieces 201 to 203, if necessary, the contents of the sealed letter, including the information such as text, graphics, and photographs, can be printed. Moreover, the content 40 is placed on the back side of the second paper piece 202. The width of the content 40 is smaller than the interval between pressure-sensitive adhesives 306 printed in both edge portions of the paper piece of the envelope sheet 200. On the back side of each of the first to third paper pieces 201 to 203, the pressure-sensitive adhesives 306 are provided along both edge portions in the width direction in a predetermined pattern of a band shape. The arrangement pattern of these pressure-sensitive adhesives 306 is considered so that when the paper pieces are folded to be assembled in the form of an envelope, the pressure-sensitive adhesives 306 of corresponding paper pieces coincide to abut with each other. However, when a number of the envelope sheets 200 are stacked on the same sides, for example, with their surfaces facing up, the pressure-sensitive adhesives 306 of the back sides do not face each other since no pressure-sensitive adhesive is present on the front sides to avoid contact. Accordingly, as in the envelope sheet 200 shown in FIG. 1 and other drawings, the problem that the stacked envelope sheets 200 are stuck to each other does not occur.

After the name, address, contents, etc. are printed, the procedure of folding and other processes when the envelope sheet 200 is formed into an envelope will be described.

Figure 16:
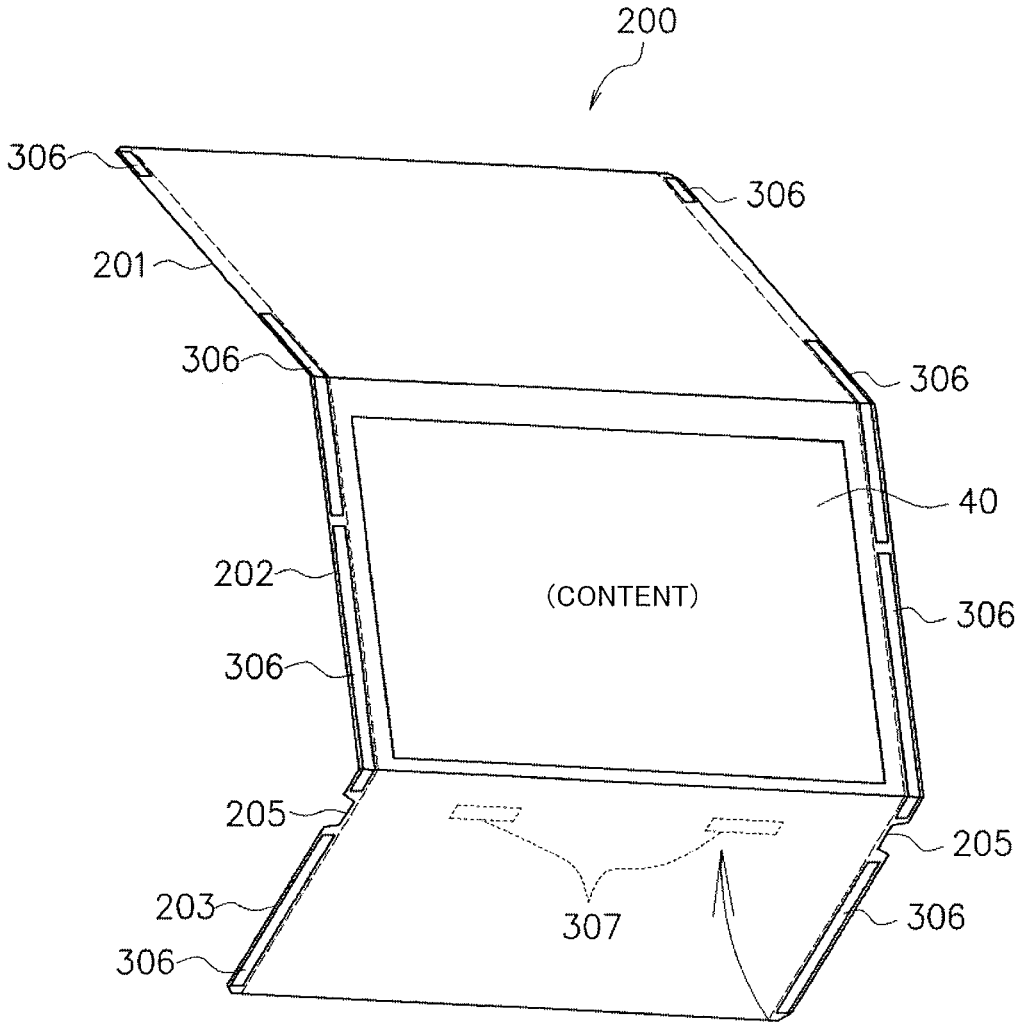

As shown in FIG. 16, in a state that the content 40 is placed on the back side of the second paper piece 202, the back side of the third paper piece 203 is placed together with the second paper piece 202 and the content 40 to bring the pressure-sensitive adhesives 306, 306 of both paper pieces 202, 203 into contact with each other. At this time, a portion of the pressure-sensitive adhesives 306 of the second paper piece 202 is exposed from the notches 205 in the third paper piece 203.

Figure 17:
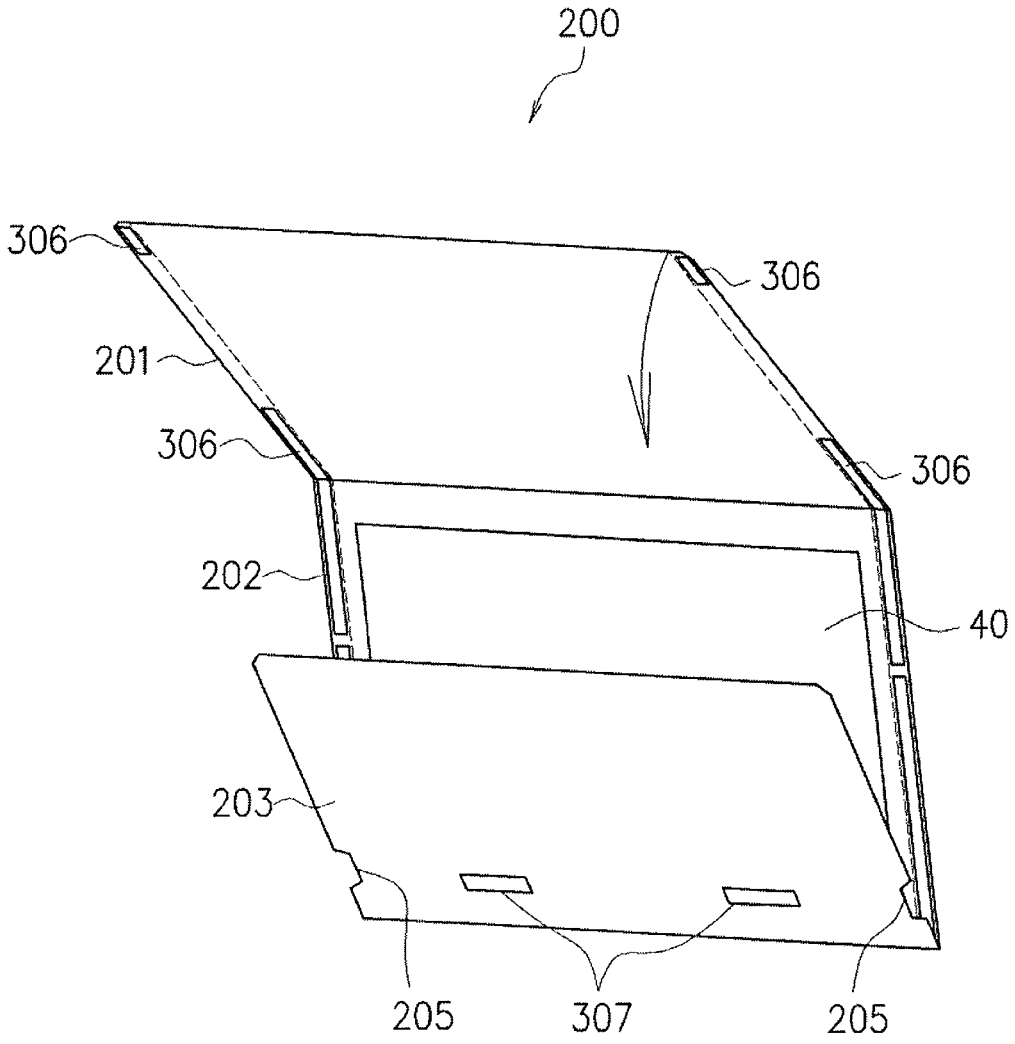
FIG. 17 A drawing showing a folding step (2) of the envelope sheet according to the second embodiment.

In FIG. 17, after water is applied to a remoistening paste 307 by a section not shown, the back side of the first paper piece 201 and the front side of the third paper piece 203 are placed together to bring the remoistening pastes 307 and the back side of the first paper piece 201 into contact, while the pressure-sensitive adhesives 306 of both paper pieces 201 and 203 are brought into contact with each other. At this time, a portion of the pressure-sensitive adhesives 306 of the second paper piece 202 exposed from the notches 205 in the third paper piece 203 is in contact with a portion of the pressure-sensitive adhesives 306 of the back side of the first paper piece 201. In this state, the envelope sheet 200 is in the form of a folded-in-three envelope, but the remoistening pastes 207 or the pressure-sensitive adhesives 306 are not adhered yet.

Thereafter, as in the case of the envelope sheet 100 shown in FIG. 1 and other drawings, the entire surface of the envelope is nipped and transferred by a roller not shown having a length equal to or greater than the width of the envelope to adhere the remoistening pastes 307 of the third paper piece 203 and the first paper piece 201. Moreover, as shown in FIG. 5, the pressure-sensitive adhesives 206 are adhered by the pressure rollers 80. Accordingly, the pressure-sensitive adhesives 306 which are in contact between the paper pieces facing each other develops tackiness, and the form of an envelope having its contents sealed is realized.

It should be noted that the enclosing and sealing operation of the envelope sheet 200 described above can be automatically performed by the above-mentioned sealed letter producing device 1 of the first embodiment.

3. Third Embodiment (FIGS. 18 to 28, FIGS. 5, 9, 12 and 13 of the First Embodiment are Referred to)

The third embodiment relates to a sheet-like envelope sheet which is capable of processing into a sealed letter by wrapping up and folding a content at the same time, and especially to relates to an envelope sheet which has the strength required for mailing and delivery in a sealing portion, while it can be easily developed into the original sheet-like envelope sheet from the state of the enclosed and sealed envelope without providing a special structure such as a perforation to open the envelope. Moreover, this embodiment relates to a sealed letter producing device which is capable of producing such an envelope sheet, printing on a paper sheet which serves as an envelope a paper sheet of a content, and enclosing and sealing the content in the envelope by folding these.

Figure 31:
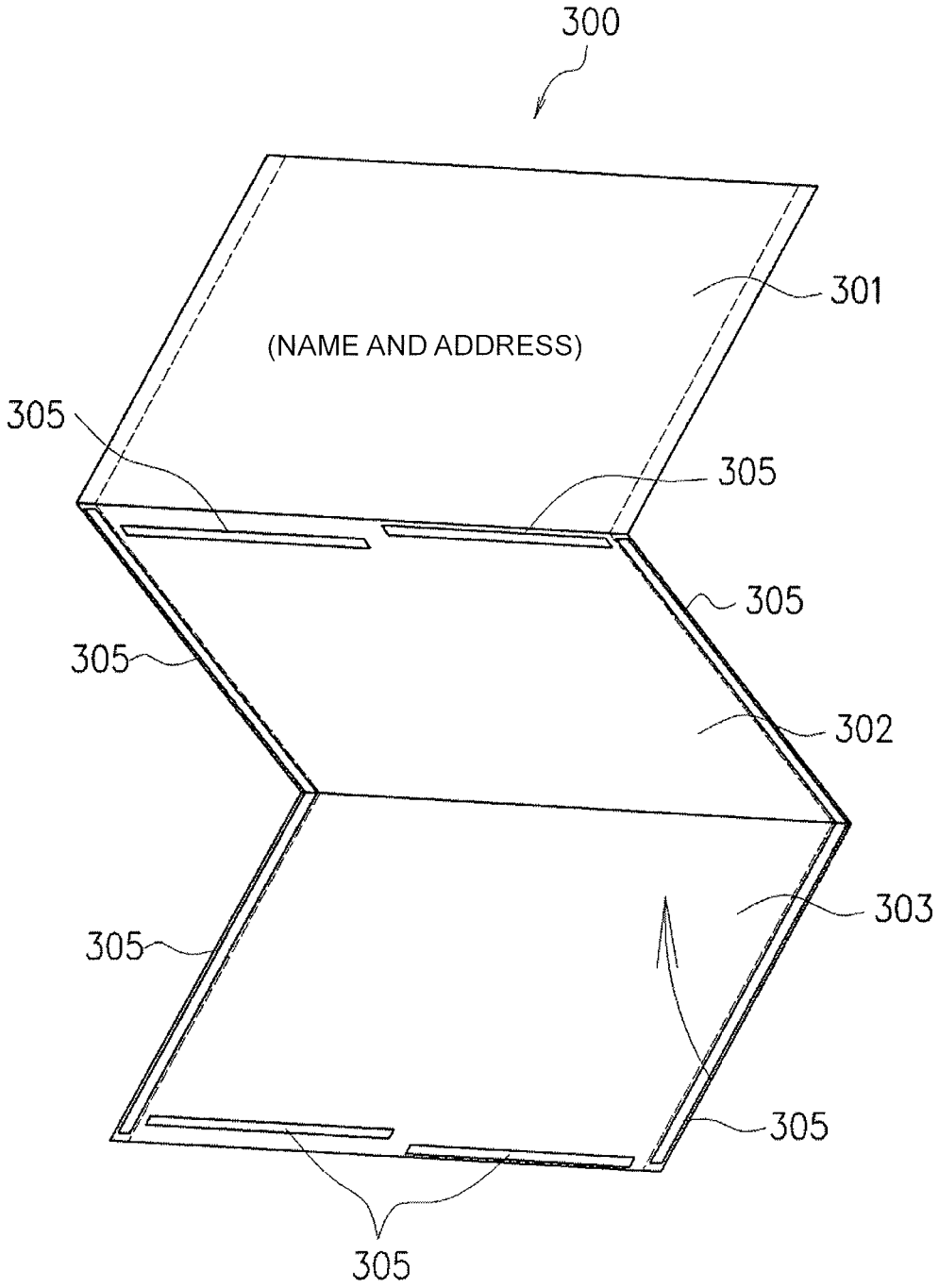
FIG. 31 A drawing showing the structure and a folding step (1) of a conventional envelope sheet.
Figure 32:
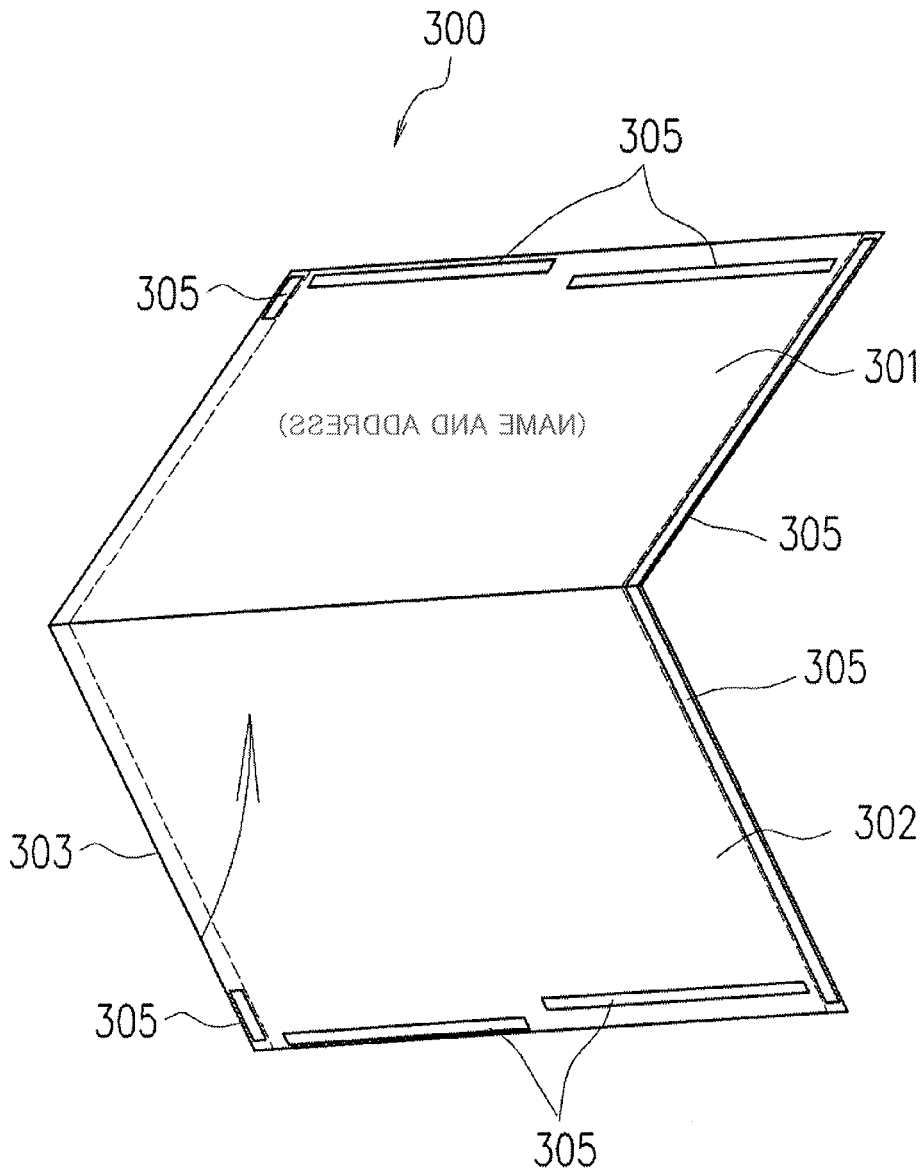
FIG. 32 A drawing showing the structure and a folding step (2) of a conventional envelope sheet.

In an envelope produced using the envelope sheet as shown in FIGS. 31 and 32, the envelope sometimes needs to be opened orderly to put it back to an original sheet state from the envelope shape, rather than being irregularly opened by tearing of adhered portion by the receiver. When, for example, text is printed inside envelope sheet, or a portion of the envelope sheet forms a return postcard, in opening the envelope by peeling off four sides of a sealed letter sealed with a pressure-sensitive adhesive, reading of the content and its use as a postcard are prevented if the envelope sheet is damaged. However, in order to open the envelope produced using the envelope sheet shown in FIGS. 31 and 32, adhered portions positioned in both edge portions of the envelope are cut off along perforations provided along both edge portions of the envelope, and then adhered portions provided in its width direction need to be opened along the other edge portions of the envelope, but it has not been an easy operation to peel off only adhered portions without damaging the envelope sheet. If other adhesives than a pressure-sensitive adhesive as an adhesive for these portions is used, the difficulty of the operation is the same. Moreover, it is possible to increase ease of opening by providing perforations referred to zippers for opening which can be easily cut open in the edge portions of the envelope along its width direction, and so that the envelope can be opened without damaging the paper sheet by cutting this off or tearing this apart, but providing such an opening structure entails the following problem: such a zipper must have both ease of tearing required for opening and durability under the stress of handling required for mailing, but this involves technical difficulties. Moreover, a special perforation processing blade is necessary to produce such complicated perforations, while it involves the problems that the production costs are high, and that the area which is assigned to the cut off portion of the zipper compresses the area for placing information of as a sealed letter.

This embodiment has been made in view of the problems as described above, and its object is to provide a sheet-like envelope sheet for producing a sealed letter by being bent in a manner of wrapping up a content, in which the strength required for mailing and delivery in a sealing portion can be obtained, while it can be easily developed into an original sheet-like envelope sheet from the state of the enclosed and sealed envelope without providing a special structure such as a perforation to open the envelope.

(1) Sealed Letter Paper Sheet Used in this Sealed Letter Producing Device (FIGS. 18 to 23 and FIG. 5)

Figure 18:
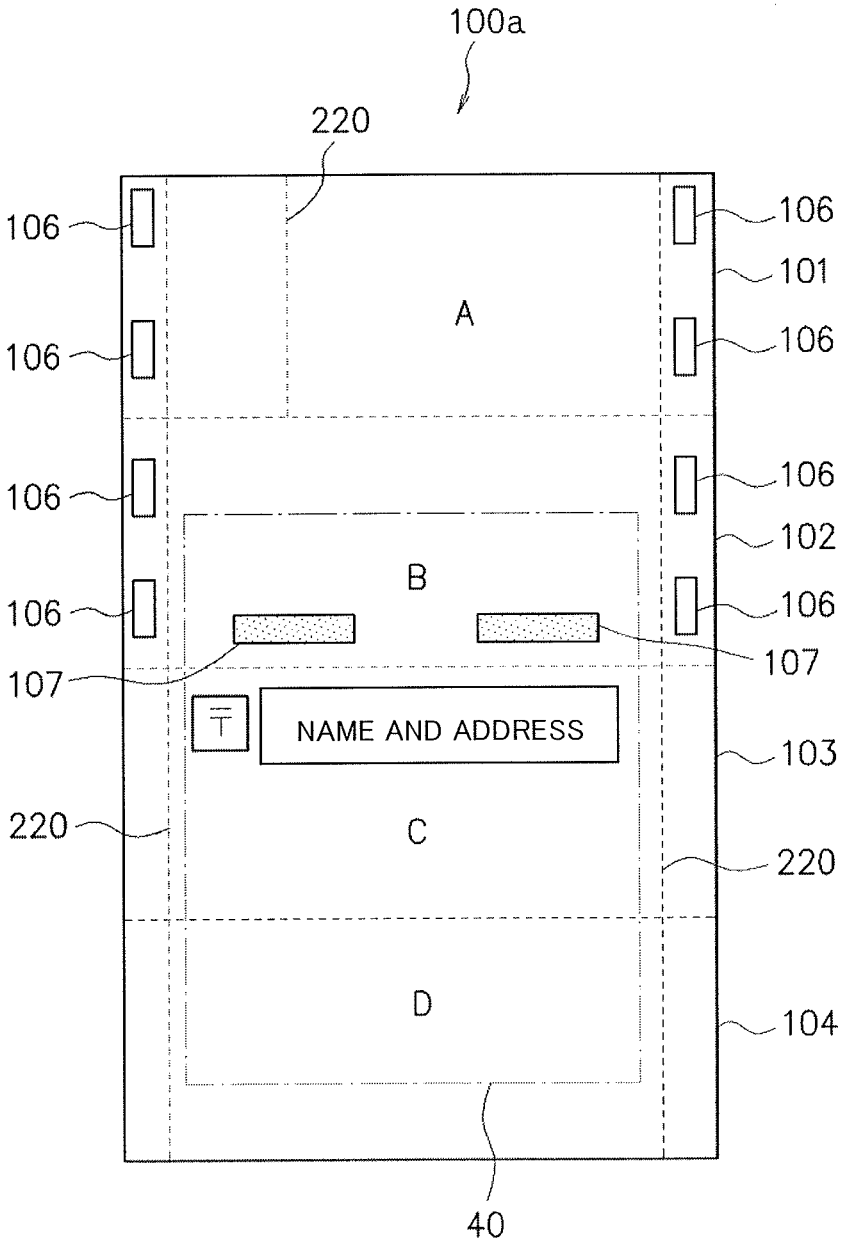
FIG. 18 A drawing of the surface of an envelope sheet according to a third embodiment.
Figure 19:
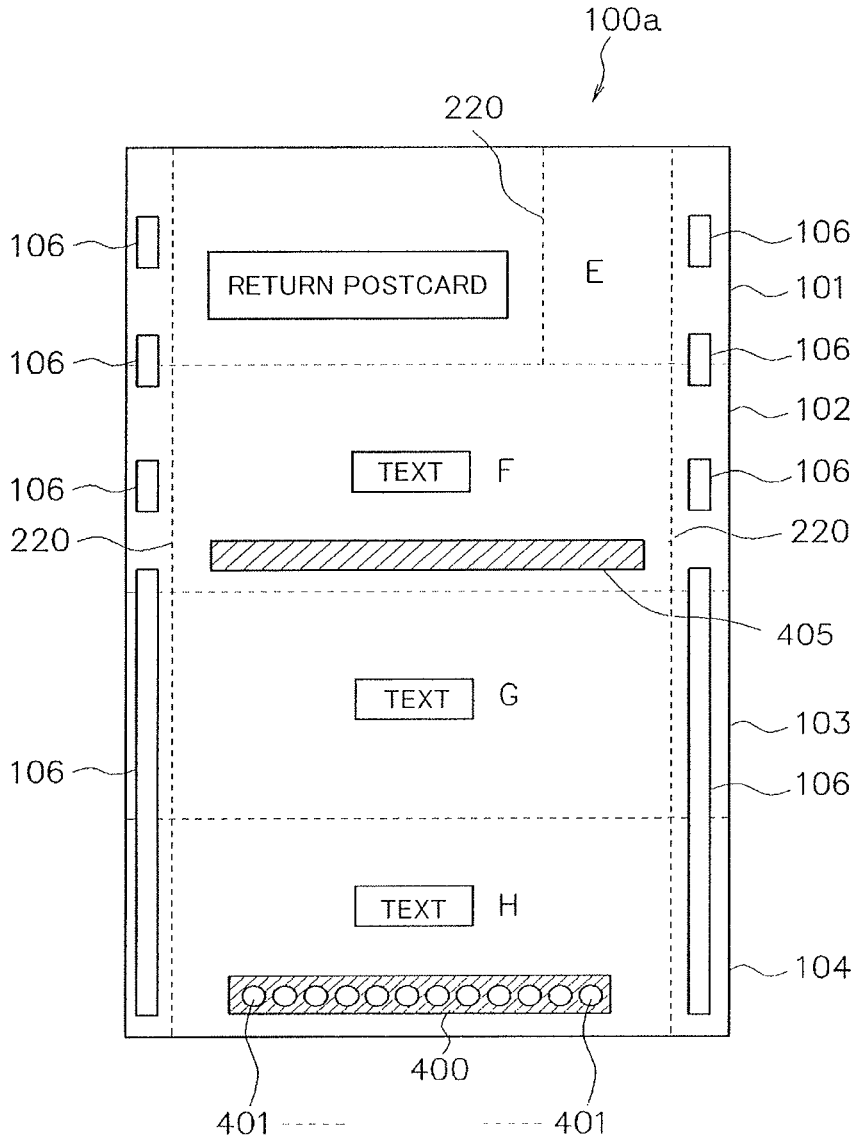
FIG. 19 A drawing of the back side of the envelope sheet according to the third embodiment.

FIG. 18 is a drawing which shows the front face (the side on which the name and address are printed) of the envelope sheet 100*a* used in this embodiment, while FIG. 19 is a drawing which shows the back side of the same. This envelope sheet 100*a* is a rectangular paper sheet including four paper pieces: a first paper piece 101, a second paper piece 102, a third paper piece 103, a fourth paper piece 104, which are connected by folds, and is formed into an envelope folded in four having the same shape as the external form of a sheet of the paper piece by folding in three portions. The front sides of the each piece of the envelope paper are denoted by the names A, B, C and D, respectively, while the back sides of the each piece of the envelope paper are denoted by the names E, F, G and H, respectively, for the convenience of explanation.

As shown in FIGS. 18 and 19, the first paper piece 101 (A, E) is a portion which is folded inside of the envelope and becomes a content. In this embodiment, the first paper piece 101 is provided with a perforation 220, and forms a return postcard by cutting off the perforation 220 after opening the envelope. Moreover, the second paper piece 102 (B, F) is a portion which is folded inside of the envelope and becomes a content. Text, images and other objects can be printed, if necessary, on the front side and back side B, F of the second paper piece 102. Moreover, the front side C of the third paper piece 103 corresponds to the front side of the envelope, on which the name and address are printed. Text, images and other objects can be printed, if necessary, on the back side G of the third paper piece 103, and the folded first paper piece 101 and the second paper piece 102 are stacked in the order stated thereon. Moreover, the front side D of the fourth paper piece 104 corresponds to the back side of the envelope, on which the name, address, etc. of the sender, if necessary, are printed. Text, images and other objects can be printed on the back side H of the fourth paper piece 104, and this back side H is stacked on the front side B of the folded second paper piece 102. As will be described later, the content enclosed in the envelope is nipped between the back side G of the third paper piece 103 and the first paper piece 101 stacked thereon. As shown in FIG. 18, the width of the content 40 is smaller than the interval between the pressure-sensitive adhesives 106 printed in both edge portions of the paper piece of the envelope sheet 100*a*. Moreover, the length in the direction perpendicular to the width of the content 40 is slightly less than the size of the same direction of the piece of the envelope sheet 100*a*, and by folding this for an appropriate number of times, a size which allows accommodation in the envelope formed from this envelope sheet 100*a*.

As shown in FIG. 18, the front side A of the first paper piece 101 and the front side B of the second paper piece 102 are provided with more than one portions of the pressure-sensitive adhesives 106 at a predetermined interval along both edge portions in the width direction. It should be noted that the front sides C and D of third paper side 103 and fourth paper side 104, respectively, are provided with no pressure-sensitive adhesive. Moreover, as shown in FIG. 19, the back side E of the first paper piece 101 and the back side F of the second paper piece 102 are provided with the pressure-sensitive adhesives 106 along both edge portions in the width direction in a plurality of portion at predetermined intervals so as to be in positions different from those of the pressure-sensitive adhesives 106 of the front sides A and B. Moreover, as shown in FIG. 19, the back side G of the third paper piece 101 and the back side H of the fourth paper piece 102 are provided with the pressure-sensitive adhesives 106 along both edge portions in the width direction in the form of a continuous band. These pressure-sensitive adhesives 106 in the form of the continuous band are formed slightly beyond the back side F of the second paper piece 102.

A pressure-sensitive adhesive exhibits adhesive strength by adhering pressure-sensitive adhesives provided on two sheets of paper together and applying a predetermined pressure. Its known examples include two-pack type adhesive using microcapsules and natural rubber-based adhesion materials, among others. The arrangement pattern of these pressure-sensitive adhesives 106 the pressure-sensitive adhesives 106 of corresponding paper pieces are considered to be in the same position and in contact with each other when the paper pieces are folded to be assembled in the form of an envelope. However, when the envelope sheet 100*a*, for example, are stacked in the same vertical positional relationship, e.g., with their front sides facing up, the pressure-sensitive adhesives 106 on the front sides and the pressure-sensitive adhesives 106 on the back sides do not face each other to avoid contact therebetween. When the pressure-sensitive adhesives 106 are brought into contact with each other and left for a long period of time, the problem of natural adhesion due to a high temperature, high humidity and other environmental conditions even without any pressure may be caused, such a problem can be prevented from occurring in advance according to the envelope sheet 100*a* of the embodiment.

As shown in FIG. 18, on the surface of B the second paper piece 102, in the positions of two portions to the inside from both edge portions in the width direction of the envelope and close to the folding bordering the third paper piece 103, remoistening pastes 107 are provided as another adhesive different from the pressure-sensitive adhesives in a band-shaped pattern along the width direction. Moreover, as shown in FIG. 19, the back side H of the fourth paper piece 104 is provided with an adhesive strength adjustment layer 400 inwardly of both edge portions in the width direction of the envelope and close to the side opposite to the fold of the third paper piece 103, in a band-shaped pattern along the width direction. The position in which the adhesive strength adjustment layer 400 is provided is a position facing the remoistening pastes 107 when this envelope sheet 100*a* is formed into an envelope. That is, when this envelope sheet 100*a* is formed into an envelope, the remoistening paste 107 is adhered to the fourth paper piece 104 via the adhesive strength adjustment layer 400.

The remoistening paste is, for example, mucilage or the like, and has no adhesive strength when it is applied on paper and dried, but develops adhesive strength when wetted with water, and when the paper sheet is placed together with another paper sheet in this state and a required pressure is applied thereto, the two paper sheets are adhered. The pressure as in the case of adhering with a remoistening paste is effective even when it is significantly lower than the pressure required for a pressure-sensitive adhesive. Since their adhesive strengths are at least both considerably higher than that of paper, using two types of adhesives in a single envelope does not cause any problem due to a variation in the adhesive strength. Moreover, in place of the remoistening paste, an adhesive which does not normally have adhesive strength but develops adhesive strength by any operation other than the pressure as for the pressure-sensitive adhesive may be used. Examples include adhesives which develop adhesive strength by heat, light including ultraviolet radiation, and other physical sections, other pressure-sensitive adhesives which develop adhesive strength with a pressure lower than that applied on the pressure-sensitive adhesive or double-faced adhesive tape and the like.

Figure 20:
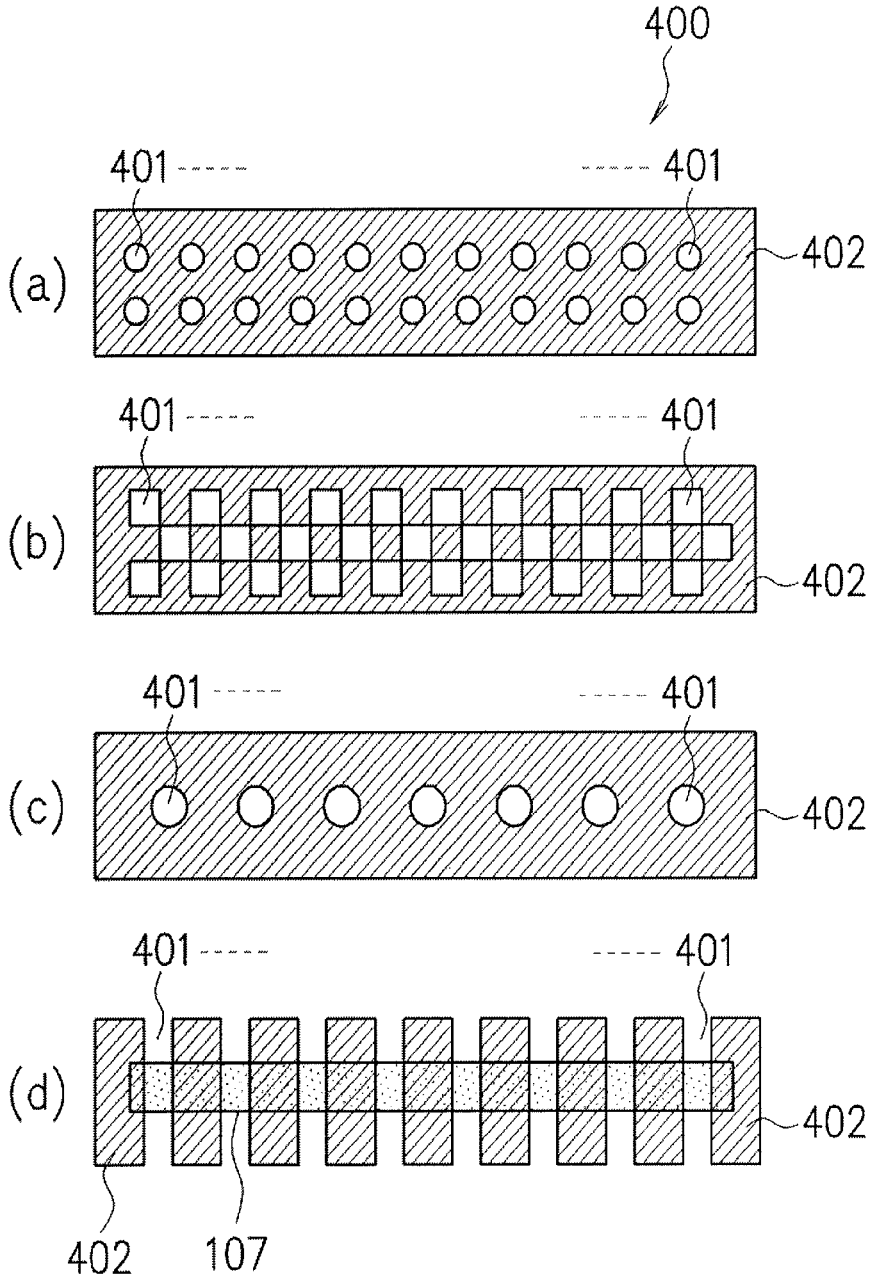
FIG. 20 A drawing showing a structural example of an adhesive strength adjustment layer provided on the envelope sheet according to the third embodiment.

The adhesive strength adjustment layer 400 may be silicon inks, waxes used for coating paper sheets, varnishes release properties, and other layers prepared from substances having low adhesiveness for various adhesives and having release properties. Herein, these substances and materials are collectively referred to as adhesion resistant materials. The formation pattern of the adhesion resistant materials is, for example, as shown in FIG. 20, that has adhesion resistant portions 402 in which the front side of the envelope sheet is covered with the adhesion resistant materials, and adhered portions 401 in which the front side of the envelope sheet is not covered with the adhesion resistant materials, and a plurality of adhered portions 401 in which the front side of the envelope sheet 100*a* is not covered with the adhesion resistant material is distributed predetermined shape and predetermined arrangement. More specifically, FIG. 20(*a*) show a pattern in which the circular adhered portions 401 are disposed in two upper and lower rows at regular intervals; FIG. 20(*b*) shows a checker pattern in which square adhered portions are disposed in three rows alternately in the vertical direction; and FIG. 20(*c*) shows a pattern in which adhered portions in the form of circles larger than those in FIG. 20(*a*) are disposed at regular intervals in a row.

In the examples of FIGS. 20 (*a*) to (*c*) above, the adhered portions are surrounded by the adhesion resistant materials, but as in FIG. 20(*d*), the following structure may also be employed: the adhesion resistant materials are formed of rectangular patterns disposed at predetermined intervals, the gaps between the rectangular patterns of the adhesion resistant materials form the adhered portions 401 where the front side of the envelope sheet 100*a* is exposed. Even if such a structure is employed, when the remoistening pastes 107 in the form of the continuous band exemplified in the figure are adhered, the remoistening paste 107 is adhered to the paper sheet in the adhered portions 401 which expose the paper sheet at constant intervals with a constant area.

In any case of FIGS. 20 (*a*) to (*d*), this adhesive strength adjustment layer 400 is a section which restricts the adhesion between the remoistening paste 107 and the envelope sheet 100*a* to a predetermined state and stabilizes the same, and therefore when both are caused to face and brought into contact, it is preferable that the formation area of the adhesive strength adjustment layer 400 includes the formation area of the remoistening paste 107, and is greater than this. That is, it is preferable that the remoistening paste 107 is adhered to the envelope sheet 100*a* only in the adhered portions of the adhesive strength adjustment layer 400, and is not adhered to the envelope sheet 100*a* irregularly outside the adhesive strength adjustment layer 400.

In such a manner, in the adhesive strength adjustment layer 400 the shapes, areas and arrangement patterns of the adhered portions 401 which are holes or gaps provided in the adhesion resistant materials where the front side of the envelope sheet 100*a* appears are determined to certain ones. The remoistening paste 107 is adhered to the envelope sheet 100*a* only through the adhered portions 401 of such patterns, and exerts almost no adhesive strength on the adhesion resistant materials of the adhesive strength adjustment layer 400. The above patterns of the adhered portions 401 in the adhesive strength adjustment layer 400 are determined as follows to simultaneously achieve two purposes which would be generally thought to contradict, that is, ease of opening of the envelope and ensuring the strength to withstand the external force applied during mailing or delivery.

First, the adhesive strength of the remoistening paste 107 in each adhered portion 401 is set to a predetermined value lower than the strength of the envelope sheet 100*a*. Accordingly, in opening the sealing portion of the envelope sheet 100*a* by means of the remoistening paste 107 and adhered portions 401, if the paper sheet is opened in the width direction sequentially from the edge, the remoistening paste 107 adhered to the paper sheet through the adhered portions 401 is peeled off from the paper sheet without damaging the paper sheet, or even if a part of the front side of the paper sheet is peeled off, can be peeled off from the paper sheet without creating such damage that a hole is made in the paper sheet. Therefore, the envelope sheet 100*a* can be opened clearly with a small force without tearing. The adhesive strength of the remoistening paste 107 in the adhered portions 401 is determined by the shape, size, disposition intervals and other conditions of the adhered portions 401 formed in the adhesive strength adjustment layer 400 when the type of the remoistening paste 107 is the same. Moreover, by performing the operation of peeling a number of dot-like adhered portions 401 having a constant adhesive strength sequentially and successively from the edge, the opener of the letter hears successive peeling sound of the adhered portions 401, and feels successive pleasing sense of opening at the fingertip, and therefore and he/she can confirm the certainty of opening by touch and ear. Accordingly, it is preferable that the arrangement pattern of the adhered portions 401 is regular since the above-described continuous peeling sound and the sense of opening can be obtained.

Next, the total adhesive strength of the remoistening paste 107 in all adhered portions 401 provided in the adhesive strength adjustment layer 400 is set to be greater than the external force possibly applied to the sealing portion of the envelope during mailing or delivery. This reduces the occurrence of the problem that the sealing portion of the envelope sheet 100*a* sealed by the remoistening paste 107 is opened by the external force applied during mailing or delivery.

According to this envelope sheet 100*a*, when the sealed envelope is opened, it can be opened without any significant damage the paper sheet with a small force, the information printed on the opened envelope sheet 100*a* is easy to read. Moreover, when the envelope has a return postcard or other object using a part of the envelope sheet 100*a*, no difficulty is found in its use. In addition, since the strength of the sealed portion by the remoistening paste 107 is set to be sufficient as a whole, accidental opening of the sealing portion sealed by the remoistening paste 107 by the external force during mailing and delivery of the envelope is unlikely to occur.

Moreover, in this embodiment, the remoistening paste 107 is formed in the shape of two bands, and the adhesive strength adjustment layer 400 is formed in the shape of a single continuous band. Therefore, when opening the sealing portion of the envelope by these, the finger can be inserted from the gap of the paper sheet corresponding to the gap between the two bands of the remoistening paste 107 to open the adhered remoistening paste 107. However, as described above, the remoistening paste 107 can be peeled off successively and clearly from the edge with a small force due to the adhesive strength adjustment layer 400, and therefore the remoistening paste 107 is not necessarily formed in the form of two bands, and may be formed in the form of a single band as the adhesive strength adjustment layer 400.

Moreover, as shown in FIGS. 18 and 19, in positions on both sides of the envelope sheet 100*a* and in the width direction on the inside from the pressure-sensitive adhesive 106, continuous perforations 220 are formed in the direction perpendicular to the width direction, so that the envelope is easy to open. However, according to this embodiment, in opening the envelope, the remoistening paste 107 of the adhered portions 401 can be clearly peeled off without damaging the paper sheet with a small force as described above first, and therefore if the portions of the pressure-sensitive adhesives 106 placed on both edges are then opened and peeled in the width direction, the operation of developing the envelope into the form of the original paper sheet can be easily performed. Therefore, the perforations on both sides in the width direction are not considered essential.

As shown in FIG. 19, on the back side F of the second paper side 102, a peeling layer 405 is provided in a band-shaped pattern along the width direction in a position to the inside from both edge portions in the width direction of the envelope and close to the folding bordering the third paper piece 103. This peeling layer 405 is formed of the adhesion resistant materials the adhesive strength adjustment layer 400, but their functions and purposes are different. This peeling layer 405 has a positional relationship which faces the remoistening paste 107 on the other envelope sheet 100*a* when the envelope sheets 100*a* are stacked in the same vertical relationship. Without this peeling layer 405, when a number of sheets of the envelope paper 100*a* are stacked the envelope sheet 100*a* in the same vertical relationship, the remoistening paste 107 may be possibly adhered to the other the envelope sheet 100*a* depending on the conditions humidity and others. However, providing the peeling layer 405 if the remoistening paste 107 develops adhesiveness when a large number of the envelope sheets 100*a* are stacked, the paper sheets are not adhered to each other, and even if they are adhered, they can be easily peeled off without damaging the envelope sheet 100*a*.

After the name, address, contents, etc. are printed, the process procedure of folds and other components in the case where the envelope sheet 100*a* is formed in the shape of the envelope will be described.

Figure 21:
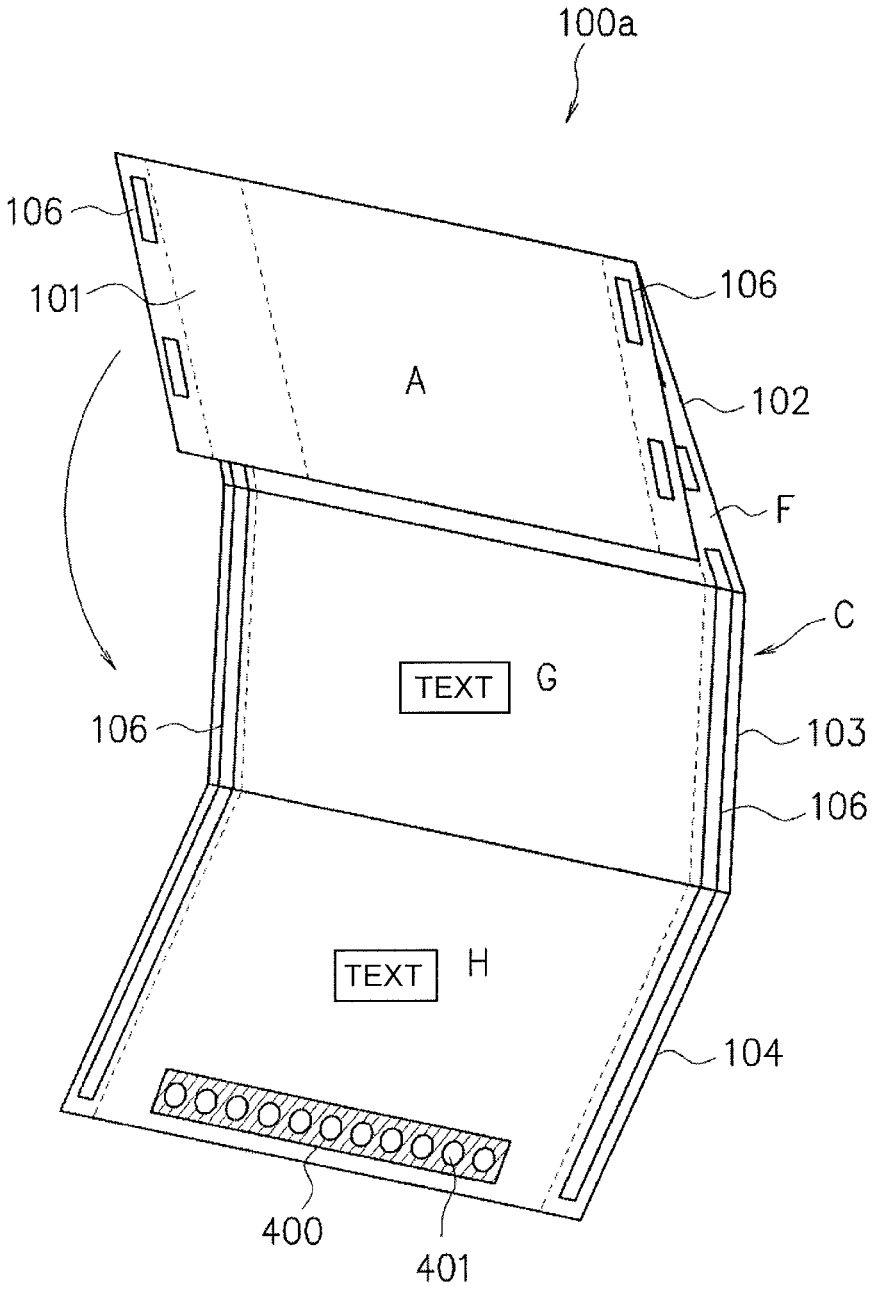
FIG. 21 A drawing showing a folding step (1) of the envelope sheet according to the third embodiment.
Figure 22:
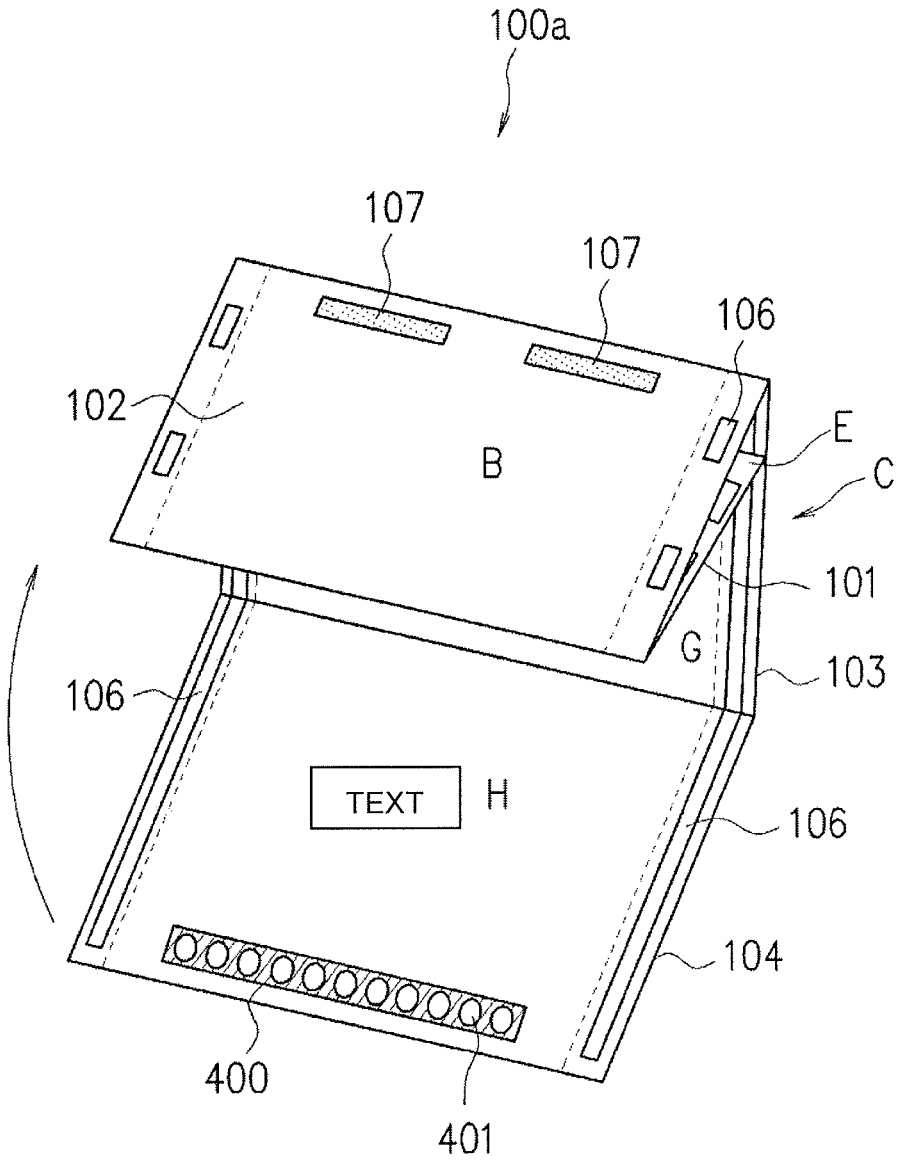
FIG. 22 A drawing showing a folding step (2) of the envelope sheet according to the third embodiment.
Figure 23:
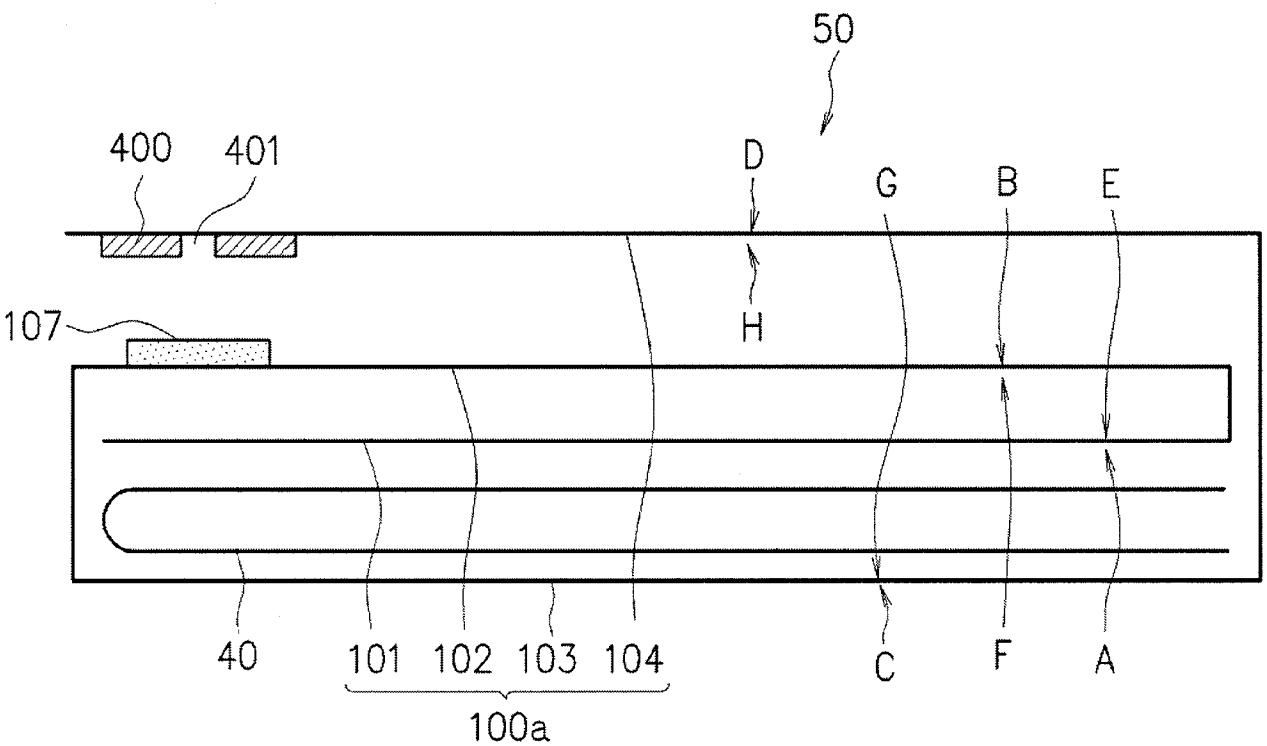
FIG. 23 A cross-sectional view showing the state after the folding step of the envelope sheet and immediately before other adhesives are adhered in the third embodiment.

As shown in FIG. 21, the first paper side 101 is bent to the back side of the envelope sheet 100*a*. The back side E of the first paper side 101 is stacked on the back side F of the second paper side 102, and the front side A of the first paper side 101 appears on the back side of the envelope sheet 100*a*. Although not illustrated, the content formed by folding is disposed on the front side A of the first paper side 101, and as shown by the arrow in FIG. 21, the first paper side 101, second paper side 102 and content, are further bent onto the back side G of the third paper side 103. As a result, the state shown in FIG. 22 is formed. Herein, after water is applied to the remoistening paste 107 provided on the front side B of the second paper side 102 by a section not shown, the fourth paper side 104 is bend to the back side of the envelope sheet 100*a* as shown the arrow in FIG. 22. The cross-sectional view of FIG. 23 schematically shows this state. The back side H of the fourth paper side 104 is stacked on the front side B of the second paper side 102, and the remoistening paste 107 of the second paper side 102 faces the adhesive strength adjustment layer 400 of the fourth paper side 104. Moreover, the pressure-sensitive adhesives 106 on the paper pieces 101 to 104 face each other or come into contact with each other. The envelope sheet 100*a* is formed in the shape of an envelope folded in four in this state, but the pressure-sensitive adhesives 106 are not adhered yet. It should be noted that in FIG. 23, the content 40 which is not illustrated in FIGS. 21 and 22 is enclosed in the state of being folded in two.

Thereafter, the entire surface of the envelope 50 is nipped by rollers not shown having a length equal to or greater than the width of the envelope to transfer the envelope 50, and the remoistening paste 107 of the second paper side 102 and the adhesive strength adjustment layer 400 of the fourth paper side 104 are adhered. Moreover, as shown in FIG. 5, the pressure-sensitive adhesives 106 placed in both edge portions in the width direction of the envelope 50 are adhered by the pressure rollers 80. A set of these pressure rollers 80 includes a set of upper and lower rollers, and two left and right pairs are provided. Both edge portions in the width direction of the envelope 50 enclosing the content 40, that is, the direction intersecting the transfer direction are nipped from above and below and pressurized to develop the adhesive strength of the pressure-sensitive adhesives 106 and achieve sealing. This causes the pressure-sensitive adhesives 106 which are in contact with each other between the paper pieces facing each other to develop tackiness, whereby the form of the envelope 50 sealing the content is realized.

It should be noted that the enclosing and sealing operation of the envelope sheet 100*a* described above is automatically performed by the sealed letter producing device 1 of the first embodiment described below.

(2) Mechanism of this Sealed Letter Producing Device (FIGS. 24 to 26 and FIG. 9)

In this paragraph, differences in configuration of the sealed letter producing device 1 of this embodiment from that of the first embodiment will be described. For the components substantially identical to those in the first embodiment, explanation is omitted by citing the description of the first embodiment.

Figure 24:
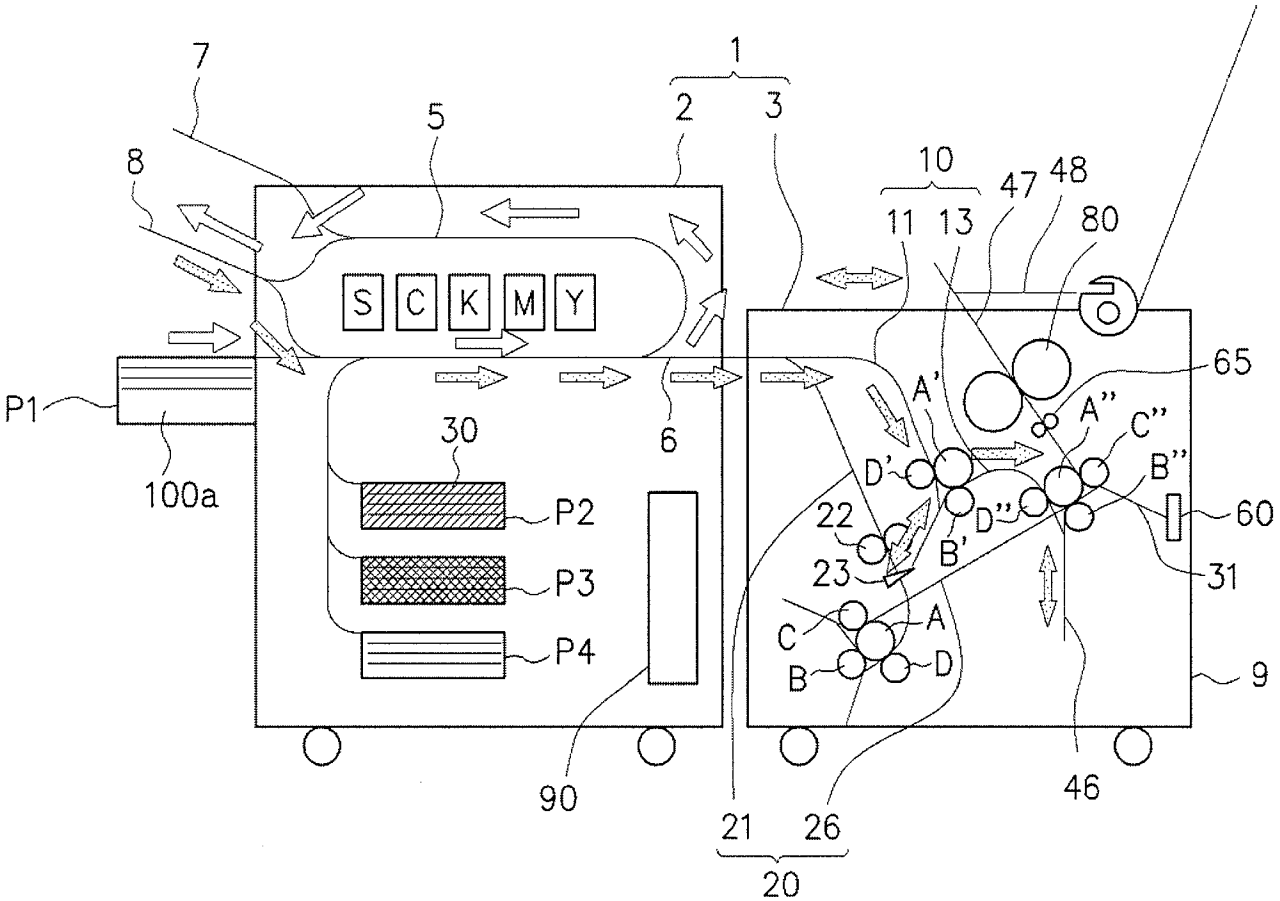
FIG. 24 A schematic cross-sectional view showing the structure of a sealed letter producing device according to the third embodiment, and the flow of an envelope in the device by arrows.
Figure 25:
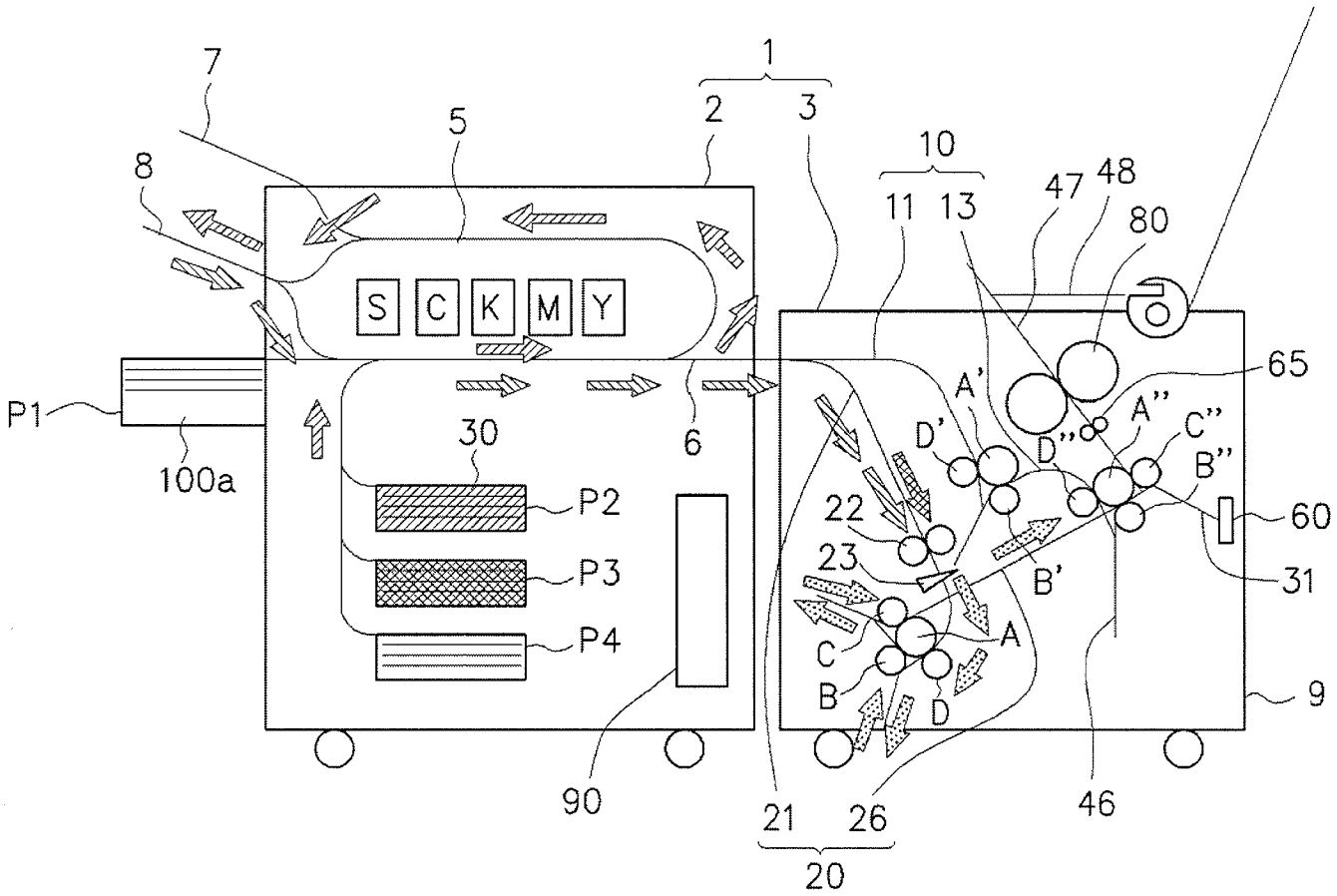
FIG. 25 A schematic cross-sectional view showing the structure of the sealed letter producing device according to the third embodiment, and the flow of the content in the device by arrows.
Figure 26:
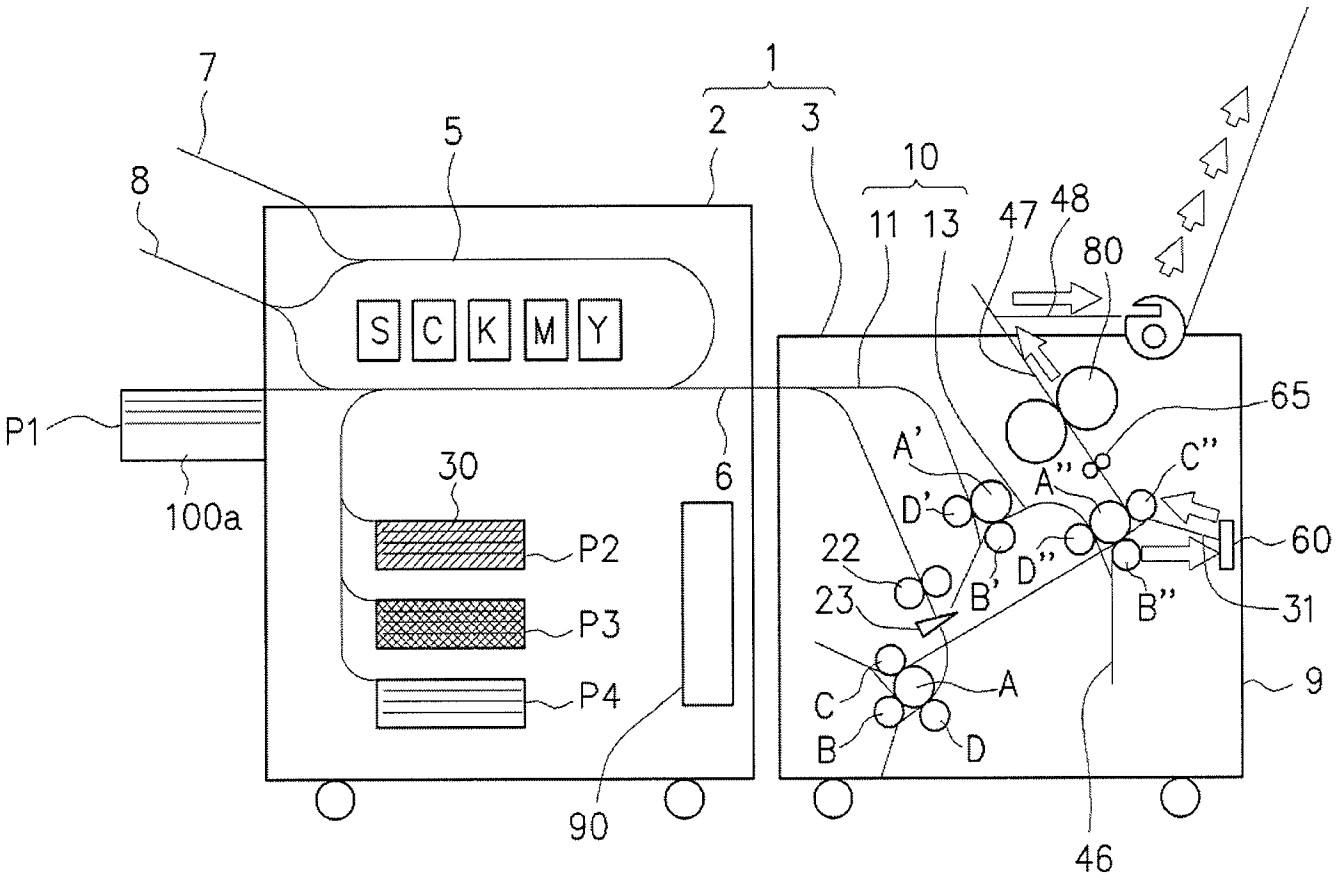
FIG. 26 A schematic cross-sectional view showing the structure of the sealed letter producing device according to the third embodiment, and a sealing operation and a discharge step of the envelope after the sealing in the device.

As shown in FIGS. 24 to 26, in the printing unit 2 of this embodiment, in order to form the adhesive strength adjustment layer 400 on the envelope sheet, a fifth ink jet device S which is a printing section capable of discharging silicon ink which is an adhesion resistant material is provided next to the four ink jet devices C, K, M and Y. Using this ink jet device S, it is possible to print the adhesive strength adjustment layer 400 on the envelope sheet in a desired pattern, and print the peeling layer 405 thereon.

Next, the enclosing and sealing section of this embodiment has substantially the same mechanical configuration as the enclosing and sealing section of the first embodiment, but has a different action or control by the control section 90 provided in the printing unit 2. The outline of the actions or controls different from those in the first embodiment will be also described in this paragraph for describing the configuration. It should be noted that the detail of the actions or controls will be described later.

According to the control section 90 of the sealed letter producing device of this embodiment, the envelope sheet 100*a* which is folded once by the main folding roller A', the first folding roller B' and other components which are the first folding section stands by where it has passed between the main folding roller A" and paper transport roller D", which are the second folding section, the content 40 transferred along the path 26, which is another second paper path 20 is aligned with the envelope sheet 100 a during standby, and further passes between the main folding roller A" and second folding roller B" to be provided with the second folding.

Figure 27:
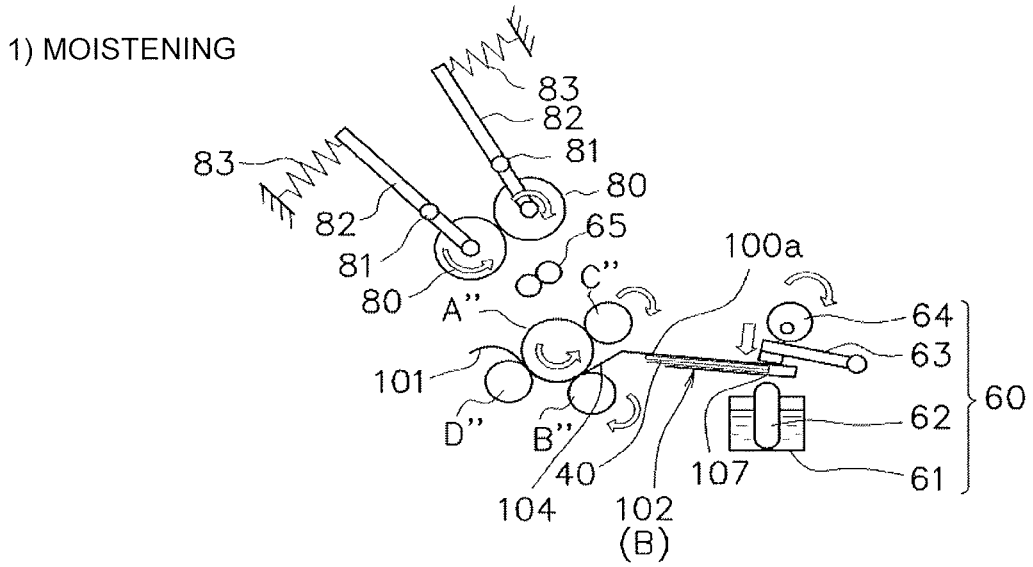
FIG. 27 A schematic front view showing a moistening step onto the remoistening paste in the enclosing and sealing unit of the sealed letter producing device of the third embodiment.

As shown in FIG. 27, the aligned envelope sheet 100*a* and content 40 are further forwarded by the main folding roller A" and second folding roller B". Herein, the envelope sheet 100*a* is in such a state that the front side B of the second paper piece 102 faces down, and the remoistening paste 107 faces the water-absorbing portion 62 of the moistening section 60. This state is close to, in FIG. 22, the state that the fourth paper piece 104 is not yet folded in the direction of the arrow, and the surface B of the second paper side 102 is faced down. Herein, the rotation cam 64 operates to swing the swing arm 63, so that the remoistening paste 107 is pressed against the water-absorbing portion 62 to be moistened.

Figure 28:
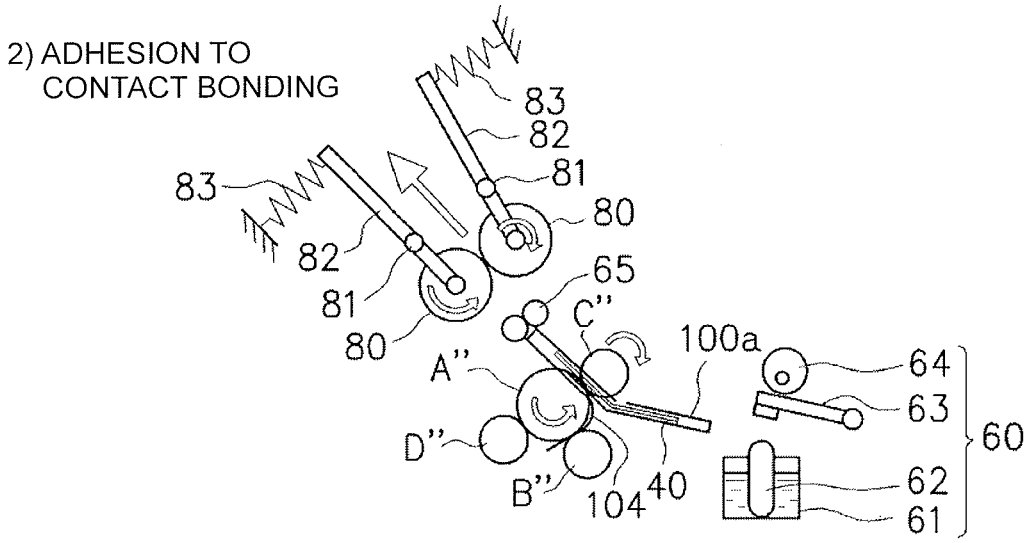
FIG. 28 A schematic front view showing the adhesion step with the remoistening paste in the enclosing and sealing unit of the sealed letter producing device of the third embodiment.

As shown in FIG. 28, the envelope sheet 100*a* is forwarded by the main folding roller A" and second folding roller C". Accordingly, the fourth paper piece 104 is folded, and the back side H of the fourth paper piece 104 is stacked on the front side B of the second paper piece 102, so that the remoistening paste 107 and adhesive strength adjustment layer 400 are adhered.

(3) Operation of this Sealed Letter Producing Device (FIGS. 24 to 28 is Referred to, while FIGS. 12 and 13 of the First Embodiment are Cited)

Next, the overall procedure of printing name, address and other information on the envelope sheet 100*a* in the sealed letter producing device 1 of this embodiment described above, performing required printing on a plurality of sheets of the content 40 and folding the same, and enclosing and sealing the content 40 in the envelope 50 formed by folding the envelope sheet 100*a* will be described.

As shown in FIG. 24, in the printing unit 2, the envelope sheet 100*a* is transferred from a paper feed rack P1. In this embodiment, the envelope sheet 100*a* may be on any of the paper feed racks P1 to P4 of the printing unit 2. This envelope sheet 100*a* is printed on both sides by the ink jet devices C, K, M and Y during a single pass around the looped transfer path 5. Not only duplex printing but also simplex printing can be selected. In general, name, address and other information are printed on the face which serves as the outer face of the envelope 50, while any information to be sent to the address, if necessary, is printed on the face which serves as the inner face of the envelope 50, along with particulars of the enclosed content 40. The information printed on the inner face of the envelope 50 can be read by a receiver by cutting and opening the envelope 50. Moreover, printing on the adhesive strength adjustment layer 400 and the peeling layer 405 by silicon ink using the ink jet device S may be performed before or after the printing step by the ink jet devices C, K, M and Y.

The envelope sheet 100*a* is transferred from the path 11, which is one of the first paper paths 10, by switching of a switching flap not shown to the folding section. The envelope sheet 100*a* is forwarded by the main folding roller A' and the paper transport roller D', impinges on an impinging member not shown to be warped, enters in between the main folding roller A' and the first folding roller B' from the warped portion, and further nipped and transferred to be provided with a fold in a portion of the front end portion thereof in the paper feed direction. The unfinished envelope which is partially folded stands by for the alignment with the content 40 in a position where it has passed between the main folding roller A" and paper transport roller D" of the enclosing and sealing section. After the alignment of the content 40, the envelope is further passed between the main folding roller A" and second folding roller B" and provided with the second folding while wrapping up the content 40, the state shown in FIG. 22 is almost formed, although the content is not shown.

As shown in FIG. 25, following the envelope sheet 100*a*, a required paper sheet 30 is transferred as the content 40 from any of the paper feed racks P2 to P4 into the looped transfer path 5 at a certain determined interval, and both sides of the paper sheet 30 are printed by the ink jet devices C, K, M and Y during a single pass through this transfer path. Not only duplex printing but also simplex printing can be selected. The paper sheet 30 of the content 40 is transferred to the path 21, which is one of the second paper paths 20 by switching of a switching flap not shown. The paper sheet 30 is retained at an alignment portion 23 on the path 21, which is one of the second paper paths 20 until a required number of sheets are accumulated, and the alignment portion 23 opens when the required number is accumulated and the sheets are transferred into the folding section (main folding roller A, etc.). By a plurality of folding performed by the folding section, the paper sheet 30 folded in a desired state is transferred into the enclosing and sealing unit (main folding roller A", etc.) via the path 26, which is the other path of the second paper paths 20. In this embodiment, the content 40 is folded inwardly in three (in the example shown in FIG. 23, a content folded in two is shown as another example). This content 40 is aligned with the envelope sheet 100*a* in the process of being folded standing by in a position where it has passed between the main folding roller A" and paper transport roller D".

As shown in FIG. 26, the aligned envelope sheet 100*a* and content 40 are further forwarded by the main folding roller A" and second folding roller B" to be provided with the second folding, whereby the content 40 is wrapped up in the envelope sheet 100*a*. Herein, as shown in FIG. 27, the rotation cam 64 of the moistening section 60 is activated to swing the swing arm 63, and the remoistening paste 107 of the envelope sheet 100*a* is pressed against the water-absorbing portion 62 to be moistened.

As shown in FIG. 28, the envelope sheet 100*a* is forwarded by the main folding roller A" and second folding roller C", the fourth paper piece 104 is folded, the adhesive strength adjustment layer 400 on the back side H of the fourth paper piece 104 is adhered with the remoistening paste 107 on the front side B of the second paper piece 102 to be in the shape of the envelope 50, and the envelope enters in between the positioning rollers 65.

As shown in FIG. 13, the positioning rollers 65 nipping the envelope 50 adjusts the position of the envelope 50 in the axial direction based on the position of the envelope 50 captured by the edge sensor 66 shown in FIG. 12, and the envelope 50 is moved to bring the pressure-sensitive adhesives 106 on the envelope 50 to a position overlapping the pressure rollers 80. In addition, both edge portions of the envelope 50 are stuck together as it passes through the pressure rollers 80, whereby sealing of the envelope 50 is performed.

According to this embodiment, in the process of folding the envelope sheet 100*a* aligned with the content 40 to form into the envelope 50, the paper pieces are adhered to each other with the remoistening paste 107 first, the positioning of the envelope 50 in the width direction is accurately performed and is then transferred in between the pressure rollers 80, so that the pressure-sensitive adhesives 106 are pressurized securely by the pressure rollers 80 having a small width. Therefore, the pressure-sensitive adhesives 106 can be securely adhered by the pressure rollers 80 which can produce a high pressure with a small force having a small width and with a width sufficient for adhesion.

Then, the finished sealed letter after the completion of enclosing and sealing is discharged into a discharge tray 48 provided on the top surface of the cabinet 9, where it is sequentially stacked up to be taken out later.

As described above, the envelope sheet 100*a* of this embodiment for producing an envelope by folding is designed to allow adhesion of both edges in the direction the width of the envelope with the pressure-sensitive adhesive 106, and the adhesion of a portion inside the pressure-sensitive adhesive 106 with the remoistening paste 107, but the adhesive strength adjustment layer 400 including a number of adhesion portions 401 from which the surface of the paper sheet are exposed regularly is configured of the adhesion resistant materials on the surface of the target paper sheet adhered by the remoistening paste 107. The adhesive strength at each point of these adhered portions 401 is set to a certain value which is lower than the breakage strength of the paper sheet, and therefore if the adhered portions are peeled off sequentially from one side, the envelope can be easily opened with a certain force. Moreover, the response felt on the hand in opening the envelope is constant, and therefore a stable and favorable sense can be obtained. Moreover, even if the adhesive strength for each point of the adhered portions 401 is small, a necessary number of adhered portions 401 are provided to set the adhesive strength as a whole as high as necessary as a whole, and therefore accidental peeling of the sealing portion of the remoistening paste 107 by a load applied during mailing or delivery can be surely prevented.

Since the remoistening paste 107 is generally formed by a step of applying in a stamping manner using a sponge-like projection component, it is difficult to form the same in the form of small dots, and even if it can be formed in the form of dots, it is even more difficult to form a paste having high viscosity in the form of dots with stable diameter, and therefore it has been actually impossible to adjust the adhesive strength in controlling of the application pattern of the remoistening paste 107. However, in this embodiment, the remoistening paste 107 is formed in the shape of a uniform band, and a pattern in which a number of holes in the form of dots is formed is printed using the adhesion resistant materials on the surface of the paper sheet facing this, point adhesion with a stable small diameter by the remoistening paste 107 can be realized, and ease of opening and unlikeliness of accidental opening during mailing and the like can be both realized.

Moreover, the envelope sheet 100*a* of this embodiment has such a configuration that the adhesive 107 and the adhesive strength adjustment layer 400 are provided in different positions of the envelope sheet 100*a*, and it therefore has such effects that it is not necessary to set the accuracy of positioning to a high level compared to the case where the adhesive 107 and adhesive strength adjustment layer 400 are formed to be stacked in the same position on the envelope sheet 100, and that the production is easy.

4. Fourth Embodiment (FIG. 29)

In the third embodiment, as shown in FIG. 23, there is such a configuration that the remoistening paste 107 is provided on the front side B of the second paper side 102, the adhesive strength adjustment layer 400 is provided on the back side H of the fourth paper side 104, and the remoistening paste 107 and adhesive strength adjustment layer 400 face each other to be adhered to each other when the envelope sheet 100*a* is folded into the shape of the envelope 50.

Figure 29:
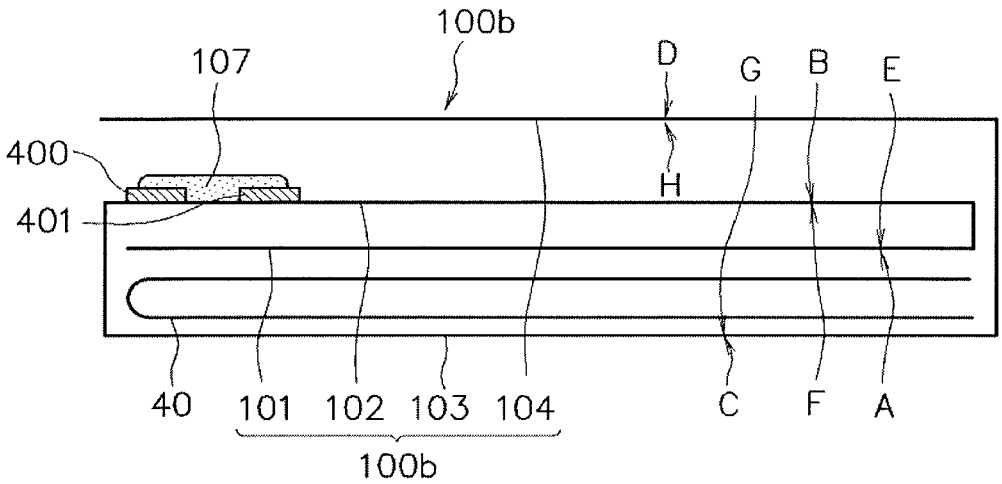
FIG. 29 A cross-sectional view showing the state after the folding step of the envelope sheet and immediately before other adhesives are adhered in the fourth embodiment.

However, the remoistening paste 107 and adhesive strength adjustment layer 400 are not necessarily formed separately on different paper sheets, but can be configured as in the fourth embodiment shown in FIG. 29. That is, in this example, the adhesive strength adjustment layer 400 having a number of adhered portions 401 (holes) is provided on the front side B of the second paper side 102, the remoistening paste 107 is provided in a range smaller than the adhesive strength adjustment layer 400 thereon, and the remoistening paste 107 is adhered to the second paper side 102 in advance by causing the remoistening paste 107 to enter the adhered portions 401. If the envelope sheet 100*b* is folded to be in the shape of an envelope in this state, the fourth paper piece 104 is adhered to the remoistening paste 107 in a large area, but the adhesive strength between the remoistening paste 107 and the second paper side 102 is as defined by the adhesive strength adjustment layer 400, and is lower than the adhesive strength between the fourth paper piece 104 and the remoistening paste 107. Therefore, in opening the envelope, the fourth paper side 104 on which the remoistening paste 107 is deposited can be peeled off from the second paper piece 102 with a small constant force.

In the third embodiment, it is possible to provide such a configuration that the remoistening paste 107 and adhesive strength adjustment layer 400 are caused to be substantially clear so that printing of the underlayer paper sheet can be visually confirmed, but the conditions for reading the information printed on the paper sheet are not considered the same as in the case where nothing exists on the paper sheet. Therefore, the smaller the areas of the remoistening paste 107 and the adhesive strength adjustment layer 400 printed on the paper sheet, the more convenient to read the information printed thereon. In this embodiment, both the remoistening paste 107 and adhesive strength adjustment layer 400 can be stacked and formed in an approximately identical position on the same paper piece, and therefore it is possible to reserve a greater area of a region where the printed information can be read more easily. Moreover, the remoistening paste 107 is moistened when used, and develops the adhesive strength by drying and shrinking after being adhered to the paper sheet, but the influence of this drying and shrinking may deform the paper in some cases. In this embodiment, the remoistening paste 107 is provided on of the adhesive strength adjustment layer 400 even partially, and therefore the remoistening paste 107 slides on the adhesive strength adjustment layer 400 when it dries and shrinks. This reduces the force applied to the paper sheet, whereby the effect in reducing the deformation of the paper sheet can be obtained.

Figure 30:
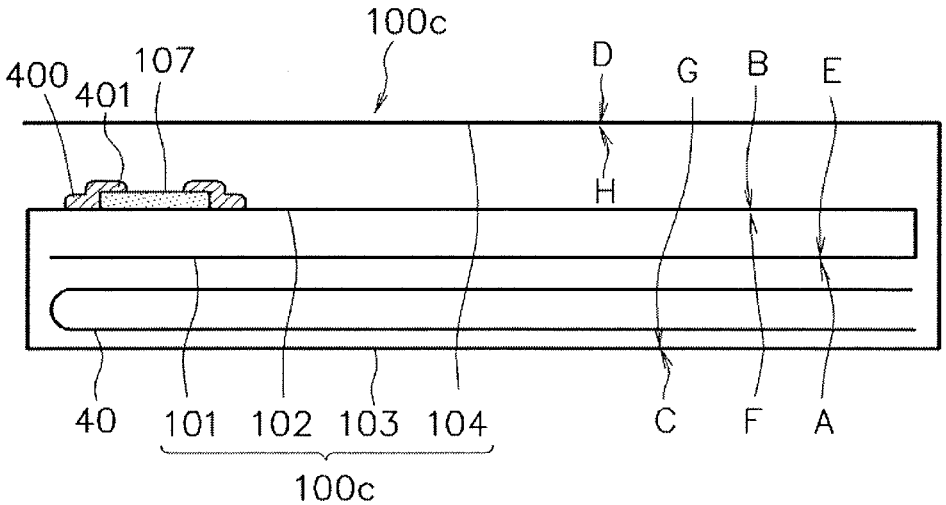
FIG. 30 A cross-sectional view showing the state after the folding step of the envelope sheet and immediately before other adhesives are adhered in the fifth embodiment.

5. Fifth Embodiment (FIG. 30)

In this example, the remoistening paste 107 is provided on the front side B of the second paper side 102, and the adhesive strength adjustment layer 400 having a number of adhered portions 401 (holes) is provided thereon to cover the remoistening paste 107. The envelope sheet 100*c* is folded and formed into the shape of an envelope in this state, and the fourth paper piece 104 is adhered to the remoistening paste 107 through the adhered portions 401 of the adhesive strength adjustment layer 400. Therefore, in opening, the fourth paper side 104 can be peeled off with a small constant force from the second paper piece 102 on which the remoistening paste 107 covered with the adhesive strength adjustment layer 400 is provided.

According to this embodiment, as in the second embodiment, both the remoistening paste 107 and the adhesive strength adjustment layer 400 can be formed on the same paper piece, and therefore the area of a region where the printed information can be read more easily can be increased. Moreover, by using the sealed letter producing device of the first embodiment including the ink jet device S which discharges the silicon ink, silicon ink is printed on the remoistening paste 107 which has been applied to the envelope sheet 100*c* in necessary positions in advance to form the adhesive strength adjustment layer 400 by printing the silicon ink on the remoistening paste 107, whereby the envelope sheet of this embodiment can be formed.

6. Variants of the Embodiments

The sealed letter producing device 1 of each of the embodiments described above is provided with the printing unit 2, but this printing unit 2 may be an existing image forming device. That is, the sealed letter producing device 1 of the present invention can be formed by using a normal image forming device already installed in places of business and other places as the printing unit 2 in the present invention, and connecting the enclosing and sealing unit 3 to this. Accordingly, printing of the envelope sheets 100, 100*a*, 100*b*, 100*c*, 200 and the content 40 can be performed by using a single existing image forming device, which would save the installation cost of the automatic sealed letter producing device.

Moreover, the paper sheet 30 of the content 40 is not necessarily folded, and may be enclosed in the envelope in its original size without being folded depending on its relationship with the size of the envelope. Moreover, in the embodiment s, the sheet-like paper sheet is used as the paper sheet 30 of the envelope paper sheets 100, 100*a*, 100*b*, 100*c*, 200 and the content 40, but, for example, a paper roll may be used, and may be cut and provided in a required length when it is used.

The invention claimed is:

1. A sealed letter producing device comprising:

a first paper path which transfers an envelope sheet;

a second paper path which transfers a content; and an enclosing and sealing unit which is disposed in a position where the first paper path and the second paper path merge, and produces a sealed letter by enclosing and sealing the content by folding the envelope sheet in a manner of containing the content, wherein the enclosing and sealing unit has a pair of pressure rollers, each having a width smaller than an application width of pressure sensitive adhesives provided in both edge portions in a width direction of the envelope sheet and facing each other in both edge portions of an envelope, the pair of pressure rollers being disposed at an interval greater than a size of the content in a width direction of the content enclosed in the envelope, and smaller than a size of the envelope in a width direction of the envelope, a moistening section which moistens a remoistening paste provided on a lower surface of the envelope sheet and inwardly of the both edge portions in the width direction of the envelope sheet, the moistening section including a water tank for storing water, a water-absorbing portion immersed into the water in the water tank, a swing arm pivotably disposed above the water tank, and configured to swing downwardly to press an upper surface of the envelope to cause the remoistening paste to be pressed against the water-absorbing portion to moisten the remoistening paste, and a driving mechanism driving the swing arm, and a folding device for folding and adhering the envelope sheet with the remoistening paste after the moistening section moistens the remoistening paste.

2. The sealed letter producing device according to claim 1, wherein in the enclosing and sealing unit, sealing is performed by applying pressure on the both edge portions of the envelope in the width direction of the envelope by the pair of pressure rollers after the envelope sheet is adhered with the remoistening paste by folding the envelope sheet with the folding device after the remoistening paste is moistened by the moistening section.

3. The sealed letter producing device according to claim 2, wherein the pair of pressure rollers is formed from a set of rollers having same shapes.

4. The sealed letter producing device according to claim 3, further comprising:

positioning rollers including two rollers having same shapes and disposed between the pair of pressure rollers and the folding device, the two rollers each having a length in an axial direction greater than a length in the width direction of the envelope sheet, the two rollers being respectively arranged above and below the envelope sheet transferred from an upstream of the two rollers, and adjusting a position in the width direction of the envelope while nipping the envelope, thereby moving the envelope to a position such that the pressure sensitive adhesives of the envelope overlap the pair of pressure rollers, and an edge sensor for detecting the edge portion of the envelope sheet transferred from the positioning rollers and outputting a positional information of the envelope sheet for moving the positioning rollers.

5. The sealed letter producing device according to claim 1, further comprising a printing unit printing the envelope sheet and the content for each sealed letter to be produced, and the printing unit includes a printing section which performs printing by an adhesion resistant material on the envelope sheet in a desired pattern.

* * * * *